US008074902B2

(12) United States Patent
Burmester et al.

(10) Patent No.: US 8,074,902 B2
(45) **Date of Patent: *Dec. 13, 2011**

(54) NOZZLE AND METHOD FOR DISPENSING RANDOM PATTERN OF ADHESIVE FILAMENTS

(75) Inventors: Thomas Burmester, Bleckede (DE); Hubert Kufner, Luneburg (DE)

(73) Assignee: Nordson Corporation, Westlake, OH (US)

( * ) Notice: Subject to any disclaimer, the term of this patent is extended or adjusted under 35 U.S.C. 154(b) by 824 days.

This patent is subject to a terminal disclaimer.

(21) Appl. No.: 12/102,501

(22) Filed: Apr. 14, 2008

(65) Prior Publication Data

US 2009/0258138 A1 Oct. 15, 2009

(51) Int. Cl.
*B05B 1/14* (2006.01)

(52) U.S. Cl. ..... 239/553.5; 239/296; 239/406; 239/553.3; 239/590.3; 239/299; 239/594

(58) Field of Classification Search ..... 239/601, 239/553.5, 296, 406, 553.3, 590.3, 299
See application file for complete search history.

(56) References Cited

U.S. PATENT DOCUMENTS

| | | | |
|---|---|---|---|
| 2,031,387 | A | 2/1936 | Schwarz |
| 2,212,448 | A | 8/1940 | Modigliani |
| 2,297,726 | A | 10/1942 | Stephanoff |
| 2,628,386 | A | 2/1953 | Tornberg |
| 3,032,008 | A | 5/1962 | Land et al. |
| 3,038,202 | A | 6/1962 | Harkenrider |
| 3,176,345 | A | 4/1965 | Powell |
| 3,178,770 | A | 4/1965 | Willis |
| 3,181,738 | A | 5/1965 | Hartvig-Johansen |
| 3,192,562 | A | 7/1965 | Powell |
| 3,192,563 | A | 7/1965 | Crompton |
| 3,204,290 | A | 9/1965 | Crompton |
| 3,213,170 | A | 10/1965 | Erdmenger et al. |
| 3,253,301 | A | 5/1966 | McGlaughlin |
| 3,334,792 | A | 8/1967 | Vries et al. |
| 3,379,811 | A | 4/1968 | Hartmann et al. |
| 3,380,128 | A | 4/1968 | Cremer et al. |

(Continued)

FOREIGN PATENT DOCUMENTS

DE 3543469 A1 12/1985

(Continued)

OTHER PUBLICATIONS

U.S. Patent and Trademark Office, Notice of Allowance/Allowability in U.S. Appl. No. 11/610,148, May 17, 2010.

(Continued)

*Primary Examiner* — Dinh Nguyen
*Assistant Examiner* — Viet Le
(74) *Attorney, Agent, or Firm* — Wood, Herron & Evans, L.L.P.

(57) ABSTRACT

A nozzle for dispensing a random pattern of liquid adhesive filaments generally comprises an adhesive shim plate positioned between first and second air shim plates. The first air shim plate includes air slots configured to direct pressurized process air along a first angle relative to the adhesive shim plate, and the second air shim plate includes air slots configured to direct pressurized process air along a second angle relative to the adhesive shim plate. The first angle is different than the second angle so that the first and second air shim plates direct the pressurized process air asymmetrically toward adhesive filaments discharging from liquid slots in the adhesive shim plate.

35 Claims, 12 Drawing Sheets

U.S. PATENT DOCUMENTS

| | | | | |
|---|---|---|---|---|
| 3,488,806 | A | 1/1970 | De Cecco et al. | |
| 3,492,692 | A | 2/1970 | Soda et al. | |
| 3,501,805 | A | 3/1970 | Douglas, Jr. et al. | |
| 3,613,170 | A | 10/1971 | Soda et al. | |
| 3,650,866 | A | 3/1972 | Prentice | |
| 3,704,198 | A | 11/1972 | Prentice | |
| 3,730,662 | A | 5/1973 | Nunning | |
| 3,755,527 | A | 8/1973 | Keller et al. | |
| 3,801,400 | A | 4/1974 | Vogt et al. | |
| 3,803,951 | A | 4/1974 | Bagley | |
| 3,806,289 | A | 4/1974 | Scharz | |
| 3,807,917 | A | 4/1974 | Shimoda et al. | |
| 3,825,379 | A | 7/1974 | Lohkamp et al. | |
| 3,847,537 | A | 11/1974 | Velie | |
| 3,849,241 | A | 11/1974 | Butin et al. | |
| 3,852,013 | A | 12/1974 | Upmeier | |
| 3,861,850 | A | 1/1975 | Wallis | |
| 3,874,886 | A | 4/1975 | Levecque et al. | |
| 3,888,610 | A | 6/1975 | Brackmann et al. | |
| 3,920,362 | A | 11/1975 | Bradt | |
| 3,923,444 | A | 12/1975 | Esper et al. | |
| 3,942,723 | A | 3/1976 | Langdon | |
| 3,954,361 | A | 5/1976 | Page | |
| 3,970,417 | A | 7/1976 | Page | |
| 3,978,185 | A | 8/1976 | Buntin et al. | |
| 3,981,650 | A * | 9/1976 | Page | 425/72.2 |
| 4,007,625 | A | 2/1977 | Houben et al. | |
| 4,015,963 | A | 4/1977 | Levecque et al. | |
| 4,015,964 | A | 4/1977 | Levecque et al. | |
| 4,050,866 | A | 9/1977 | Kilsdonk | |
| 4,052,002 | A | 10/1977 | Stouffer et al. | |
| 4,052,183 | A | 10/1977 | Levencque et al. | |
| 4,100,324 | A | 7/1978 | Anderson et al. | |
| 4,145,173 | A | 3/1979 | Pelzer et al. | |
| 4,151,955 | A | 5/1979 | Stouffer | |
| 4,185,981 | A | 1/1980 | Ohsato et al. | |
| 4,189,455 | A | 2/1980 | Raganato et al. | |
| 4,277,436 | A | 7/1981 | Shah et al. | |
| 4,300,876 | A | 11/1981 | Kane et al. | |
| 4,340,563 | A | 7/1982 | Appel et al. | |
| 4,359,445 | A | 11/1982 | Kane et al. | |
| 4,380,570 | A | 4/1983 | Schwarz | |
| 4,414,276 | A | 11/1983 | Kiriyama et al. | |
| 4,457,685 | A | 7/1984 | Huang et al. | |
| 4,468,366 | A | 8/1984 | Socha, Jr. | |
| 4,526,733 | A | 7/1985 | Lau | |
| 4,548,632 | A | 10/1985 | Tanaka et al. | |
| 4,568,506 | A | 2/1986 | Kiriyama et al. | |
| 4,596,364 | A | 6/1986 | Bauer | |
| 4,645,444 | A | 2/1987 | Lenk et al. | |
| 4,652,225 | A | 3/1987 | Dehennau et al. | |
| 4,694,992 | A | 9/1987 | Stouffer | |
| 4,708,619 | A | 11/1987 | Balk | |
| 4,709,836 | A | 12/1987 | Andersen | |
| 4,711,683 | A | 12/1987 | Merkatoris | |
| 4,730,197 | A | 3/1988 | Raman et al. | |
| 4,746,283 | A | 5/1988 | Hobson | |
| 4,747,986 | A | 5/1988 | Chao | |
| 4,774,109 | A | 9/1988 | Hadzimihalis et al. | |
| 4,785,996 | A | 11/1988 | Ziecker et al. | |
| 4,812,276 | A | 3/1989 | Chao | |
| 4,818,463 | A | 4/1989 | Buehning | |
| 4,818,464 | A | 4/1989 | Lau | |
| 4,826,415 | A | 5/1989 | Mende | |
| 4,842,666 | A | 6/1989 | Werenicz | |
| 4,844,003 | A | 7/1989 | Slautterback et al. | |
| 4,874,451 | A | 10/1989 | Boger et al. | |
| 4,875,844 | A | 10/1989 | Nakajima et al. | |
| 4,889,476 | A | 12/1989 | Buehning | |
| RE33,158 | E | 2/1990 | Stouffer et al. | |
| RE33,159 | E | 2/1990 | Bauer | |
| 4,905,909 | A | 3/1990 | Woods | |
| 4,918,017 | A | 4/1990 | Greenstreet et al. | |
| 4,923,706 | A | 5/1990 | Binley et al. | |
| 4,949,668 | A | 8/1990 | Heindel et al. | |
| 4,955,547 | A | 9/1990 | Woods | |
| 4,960,619 | A | 10/1990 | Slautterback et al. | |
| RE33,448 | E | 11/1990 | Bauer | |
| RE33,481 | E | 12/1990 | Ziecker et al. | |
| 4,983,109 | A | 1/1991 | Miller et al. | |
| 5,013,232 | A | 5/1991 | Way | |
| 5,017,116 | A | 5/1991 | Carter et al. | |
| 5,035,361 | A | 7/1991 | Stouffer | |
| 5,066,435 | A | 11/1991 | Lorenz et al. | |
| 5,067,885 | A | 11/1991 | Stevenson et al. | |
| 5,069,853 | A | 12/1991 | Miller | |
| 5,094,792 | A | 3/1992 | Baran | |
| 5,098,636 | A | 3/1992 | Balk | |
| 5,114,752 | A | 5/1992 | Hall | |
| 5,124,111 | A | 6/1992 | Keller et al. | |
| 5,129,585 | A | 7/1992 | Bauer | |
| 5,145,689 | A | 9/1992 | Allen et al. | |
| 5,147,197 | A | 9/1992 | Hodan et al. | |
| 5,160,746 | A | 11/1992 | Dodge, II et al. | |
| 5,165,940 | A | 11/1992 | Windley | |
| 5,169,071 | A | 12/1992 | Boger et al. | |
| 5,209,410 | A | 5/1993 | Wichmann et al. | |
| 5,234,650 | A | 8/1993 | Hagen et al. | |
| 5,242,644 | A | 9/1993 | Thompson et al. | |
| 5,260,003 | A | 11/1993 | Nyssen et al. | |
| 5,269,670 | A | 12/1993 | Allen et al. | |
| 5,275,676 | A | 1/1994 | Rooyakkers et al. | |
| 5,312,500 | A | 5/1994 | Kurihara et al. | |
| 5,342,647 | A | 8/1994 | Heindel et al. | |
| 5,354,378 | A | 10/1994 | Hauser et al. | |
| 5,393,219 | A | 2/1995 | Hagen et al. | |
| 5,397,227 | A | 3/1995 | Hodan et al. | |
| 5,407,619 | A | 4/1995 | Maeda et al. | |
| 5,409,733 | A | 4/1995 | Boger et al. | |
| 5,418,009 | A | 5/1995 | Raterman et al. | |
| 5,421,921 | A | 6/1995 | Gill et al. | |
| 5,421,941 | A | 6/1995 | Allen et al. | |
| 5,423,935 | A | 6/1995 | Benecke et al. | |
| 5,429,840 | A | 7/1995 | Raterman et al. | |
| 5,445,509 | A | 8/1995 | Allen et al. | |
| 5,458,291 | A | 10/1995 | Brusko et al. | |
| 5,458,721 | A | 10/1995 | Raterman | |
| 5,476,616 | A | 12/1995 | Schwarz | |
| 5,478,224 | A | 12/1995 | McGuffey | |
| D367,865 | S | 3/1996 | Bajadali | |
| 5,503,784 | A | 4/1996 | Balk | |
| 5,512,793 | A | 4/1996 | Takeuchi et al. | |
| 5,524,828 | A | 6/1996 | Raterman et al. | |
| 5,533,675 | A | 7/1996 | Benecke et al. | |
| 5,540,804 | A | 7/1996 | Raterman | |
| 5,551,588 | A | 9/1996 | Hills | |
| 5,605,706 | A | 2/1997 | Allen et al. | |
| 5,618,347 | A | 4/1997 | Clare et al. | |
| 5,618,566 | A | 4/1997 | Allen et al. | |
| 5,620,139 | A | 4/1997 | Ziecker | |
| 5,620,664 | A | 4/1997 | Palmer | |
| 5,645,790 | A | 7/1997 | Schwarz et al. | |
| 5,667,750 | A | 9/1997 | Nohr et al. | |
| 5,679,379 | A | 10/1997 | Fabbricante et al. | |
| 5,902,540 | A | 5/1999 | Kwok | |
| 5,904,298 | A | 5/1999 | Kwok et al. | |
| 5,927,560 | A | 7/1999 | Lewis et al. | |
| 5,964,973 | A | 10/1999 | Heath et al. | |
| 5,992,688 | A | 11/1999 | Lewis et al. | |
| D420,099 | S | 2/2000 | Lewis et al. | |
| 6,051,180 | A | 4/2000 | Kwok | |
| 6,074,597 | A | 6/2000 | Kwok et al. | |
| D429,263 | S | 8/2000 | Auber et al. | |
| 6,235,137 | B1 | 5/2001 | Van Eperen et al. | |
| 6,264,113 | B1 | 7/2001 | Dingler | |
| D456,427 | S | 4/2002 | Gressett, Jr. et al. | |
| 6,375,099 | B1 * | 4/2002 | McGuffey | 239/553.5 |
| D457,538 | S | 5/2002 | Gressett, Jr. et al. | |
| D460,092 | S | 7/2002 | Gressett, Jr. et al. | |
| D461,483 | S | 8/2002 | Gressett, Jr. et al. | |
| 6,540,152 | B2 | 4/2003 | Holm et al. | |
| 6,540,831 | B1 | 4/2003 | Craine et al. | |
| 6,578,773 | B2 | 6/2003 | Holm et al. | |
| 6,676,038 | B2 | 1/2004 | Gressett, Jr. et al. | |
| 6,680,021 | B1 | 1/2004 | Kwok et al. | |
| 6,890,167 | B1 | 5/2005 | Kwok et al. | |
| 6,938,795 | B2 | 9/2005 | Barton, Jr. et al. | |

| | | | | |
|---|---|---|---|---|
| D519,536 | S | 4/2006 | de Leeuw et al. | |
| D520,538 | S | 5/2006 | de Leeuw et al. | |
| D521,035 | S | 5/2006 | de Leeuw et al. | |
| D524,833 | S | 7/2006 | Folk et al. | |
| D529,321 | S | 10/2006 | Gould et al. | |
| D536,354 | S | 2/2007 | Kufner et al. | |
| D550,261 | S | 9/2007 | Bondeson et al. | |
| 7,798,434 | B2 * | 9/2010 | Bondeson et al. | 239/601 |
| 2004/0124251 | A1 | 7/2004 | Gressett, Jr. et al. | |
| 2005/0205689 | A1 | 9/2005 | Crane et al. | |
| 2008/0145530 | A1 | 6/2008 | Bondeson et al. | |

FOREIGN PATENT DOCUMENTS

| | | | |
|---|---|---|---|
| DE | 19715740 | A1 | 4/1997 |
| EP | 0893517 | A2 | 1/1999 |
| EP | 0979885 | A2 | 2/2000 |
| EP | 1155745 | A2 | 11/2001 |
| EP | 0835952 | B1 | 2/2003 |
| EP | 0872580 | B1 | 6/2005 |
| GB | 756907 | | 9/1956 |
| GB | 1392667 | | 4/1975 |
| WO | 9207122 | A1 | 4/1992 |
| WO | 9315895 | A1 | 8/1993 |
| WO | 9904950 | A1 | 2/1999 |
| WO | 03/086655 | A1 | 10/2003 |

OTHER PUBLICATIONS

Nordson Corporation, Today's Idea, Nordson Unveils Diaper Elastic System, Oct. 1988, 1 pg.

Nordson Corporation, Adhesive and Powder Application Systems for the Nonwoven Industry, 1992, 7 pgs.

Edward K. McNalley et al., J&M Laboratories, Durafiber/Durastitch Adhesives Applications Methods Featuring Solid State Application Technology disclosed Sep. 8, 1997 at Inda-Tec 97 Meeting, Cambridge MA, pp. 26.1-26-8.

Rajiv S. Rao et al., Vibration and Stability in the Melt Blowing Process, Ind. Eng. Chem. Res., 1993, 32, 3100-3111.

Gregory F. Ward, Micro-Denier Nonwoven Process and Fabrics, on or about Oct. 17, 1997, pp. 1-9.

Scott R. Miller, Beyond Meltblowing: Process Refinement in Microfibre Hot Melt Adhesive Technology, Edana 1998 International Nonwovens Symposium, 11 pgs.

European Patent Office, European Search Report in EP Application No. 07122920, Aug. 27, 2008.

European Patent Office, Partial European Search Report in EP Application No. 09157856, Sep. 6, 2011.

* cited by examiner

NOZZLE AND METHOD FOR DISPENSING RANDOM PATTERN OF ADHESIVE FILAMENTS

TECHNICAL FIELD

The present invention relates generally to air-assisted nozzles and systems for extruding and moving filaments of viscous liquid in desired patterns and, more particularly, air-assisted dispensing of hot melt adhesive filaments.

BACKGROUND

Various dispensing systems have been used in the past for applying patterns of viscous liquid material, such as hot melt adhesives, onto a moving substrate for a wide range of manufacturing purposes, including but not limit to packaging, assembly of various products, and construction of disposable absorbent hygiene products. Thus, the dispensing systems as described are used in the production of disposable absorbent hygiene products such as diapers. In the production of disposable absorbent hygiene products, hot melt adhesive dispensing systems have been developed for applying a laminating or bonding layer of hot melt thermoplastic adhesive between a nonwoven fibrous layer and a thin polyethylene backsheet. Typically, the hot melt adhesive dispensing system is mounted above a moving polyethylene backsheet layer and applies a uniform pattern of hot melt adhesive material across the upper surface width of the backsheet substrate. Downstream of the dispensing system, a nonwoven layer is laminated to the polyethylene layer through a pressure nip and then further processed into a final usable product.

In various known hot melt adhesive dispensing systems, continuous filaments of adhesive are emitted from a plurality of adhesive outlets with plural process air jets oriented in various configurations adjacent the circumference of each adhesive outlet. The plural air jets discharge air in a converging, diverging, or parallel manner relative to the discharged adhesive filament or fiber as the filament emerges from the adhesive outlet. This process air can generally attenuate each adhesive filament and cause the filaments to move in overlapping or non-overlapping patterns before being deposited on the moving substrate.

Manufacturers in many fields, including manufacturers of disposable absorbent hygiene products, are interested in small fiber technology for the bonding layer of hot melt adhesive in nonwoven and polyethylene sheet laminates. To this end, hot melt adhesive dispensing systems have incorporated slot nozzle dies with a pair of air channels formed on each side of the elongated extrusion slot of the die. The air channels are angled relative to the extrusion slot and arranged symmetrically so that curtains of pressurized process air are emitted on opposite sides of the extrusion slot. Thus, as hot melt adhesive is discharged from the extrusion slot as a continuous sheet or curtain, the curtains of process air impinge upon and attenuate the adhesive curtain to form a uniform web of adhesive on the substrate.

Meltblown technology has also been adapted for use in this area to produce a hot melt adhesive bonding layer having fibers of relatively small diameter. Meltblown dies typically include a series of closely spaced adhesive nozzles or orifices that are aligned on a common axis across the die head. A pair of angled air channels or individual air passages and orifices are positioned on both sides of the adhesive nozzles or orifices and aligned parallel to the common nozzle axis. As hot melt adhesive discharges from the series of aligned nozzles or orifices, pressurized process air is discharged from the air channels or orifices to attenuate the adhesive fibers or filaments before they are applied to the moving substrate. The air may also cause the fibers to oscillate in a plane that is generally aligned with the movement of the substrate (i.e., in the machine direction) or in a plane that is generally aligned in the cross-machine direction.

One of the challenges associated with the above-described technologies relates to the production of fibrous adhesive layers during intermittent operations. More specifically, for some applications it is desirable to produce discrete patterns of fibrous adhesive layers rather than a continuous adhesive layer. Although known fibrous adhesive dispensers incorporate intermittent control of the adhesive and air flows to produce such discrete patterns, providing the discrete patterns with well-defined edges can be difficult to achieve.

For example, the velocity of the air directed at the adhesive must be sufficient to cleanly "break" the filaments when adhesive flow is stopped. Otherwise the filaments may continue to "string" along so that there is no clearly defined cut-off edge and cut-on edge between adjacent patterns deposited on the moving substrate. When high velocity air is used, however, the pattern of fibers between the cut-on and cut-off edges becomes more difficult to control. This is particularly true when high velocity air flows converge to impinge opposite sides the adhesive filaments. The filaments may end up breaking constantly during the dispensing cycle rather than merely at the starting and stopping points of the adhesive flow.

A related problem resulting from high velocity air directed in this manner is "fly," which occurs when the adhesive gets blown away from the desired deposition pattern. The "fly" can be deposited either outside the desired edges of the pattern, or even build up on the dispensing equipment and cause operational problems that require significant maintenance. High velocity air, in combination with closely spaced nozzles, can also cause "shot" in which adjacent adhesive filaments become entangled and form globules of adhesive on the substrate. "Shot" is undesirable because it can cause heat distortion of delicate polyethylene backsheet substrates.

As can be appreciated, known adhesive dispensers that produce continuous, fibrous adhesive layers may not be particularly suitable for intermittent operations. Therefore, there remains room for improvement in this area of fibrous adhesive dispensing technology.

SUMMARY

In an illustrative embodiment, a nozzle for dispensing a random pattern of liquid adhesive filaments generally comprises first and second air shim plates and an adhesive shim plate positioned between the first and second air shim plates. The adhesive shim plate has a plurality of liquid slots adapted to receive and discharge pressurized liquid adhesive. The first and second air shim plates each have a plurality of air slots adapted to receive and direct pressurized process air. This pressurized process air forms a zone of turbulence for moving filaments of the pressurized liquid adhesive discharging from the liquid slots.

In one embodiment, the first air shim plate is configured to direct the pressurized process air along a first angle relative to the adhesive shim plate and the second air shim plate is configured to direct the pressurized process air along a second angle relative to the adhesive shim plate. The first angle is different than the second angle and, therefore, the first and second air shim plates direct the pressurized process air asymmetrically toward the adhesive filaments. Various arrangements of shim plates as well as other forms of nozzle constructions not using shim plates are possible to achieve this asymmetrical air flow.

For example, the first and second air shim plates and the adhesive shim plate are coupled to a nozzle body. The nozzle body includes first and second surfaces generally converging toward each other, with the adhesive shim plate and the first air shim plate being coupled to the first surface so as to be arranged substantially parallel thereto, and the second air shim plate being coupled to the second surface so as to be arranged substantially parallel thereto. A separating shim plate is positioned between the first air shim plate and the adhesive shim plate.

The air slots in the first and second air shim plates are arranged in respective pairs. Additionally, each of the liquid slots in the adhesive shim plate are arranged generally between a pair of the air slots in the first air shim plate and a pair of the air slots in the second air shim plate thereby associating four air slots with each liquid slot.

In another embodiment, only the air slots in the second air shim plate are arranged in pairs. Each of the liquid slots in the adhesive shim plate is arranged generally between one air slot in the first air shim plate and a pair of air slots in the second air shim plate thereby associating three air slots with each liquid slot. This results in three streams of pressurized process air being directed toward each of the adhesive filaments. Each air slot in the first air shim plate directs a single stream of pressurized process air generally parallel to the adhesive filament discharging from the associated liquid outlet, while each pair of air slots in the second air shim plate directs two streams of pressurized process air generally at the adhesive filament discharging from the associated liquid outlet.

In a further embodiment, neither the air slots in the first air shim plate nor the air slots in the second air shim plate are arranged in respective pairs. Instead, each of the liquid slots in the adhesive shim plate is arranged generally between one air slot in the first air shim plate and one air slot in the second air shim plate thereby associating two air slots with each liquid slot. Two streams of pressurized process air are thus directed toward each adhesive filament. In particular, each air slot in the first air shim plate directs a single stream of pressurized process air generally parallel to the adhesive filament discharging from the associated liquid outlet. Each air slot in the second air shim plate directs a single stream of pressurized process air generally at the adhesive filament discharging from the associated liquid outlet.

In yet another embodiment, a nozzle comprises a plurality of liquid outlets configured to respectively discharge a plurality of liquid adhesive filaments. At least one air passage is associated with one of the liquid outlets and configured to direct pressurized process air along a first angle relative to a plane including the associated liquid outlet. Additionally, at least one air passage is associated with one of the liquid outlets and configured to direct pressurized process air along a second angle relative to the plane including the associated liquid outlet. The different air passages are on opposite sides of one of the liquid outlets. Although the detailed description below focuses on an exemplary nozzle arrangement in which the plurality of liquid outlets are arranged in a row and first and second pluralities of air passages are located on opposite sides of a plane including the row, a "series" or "in-line" arrangement of the liquid outlets and the air passages may alternatively be provided. In either arrangement, the first angle is different than the second angle such that the different air passages direct the pressurized process air asymmetrically toward the liquid adhesive filaments discharging from the respective liquid outlets to produce the random pattern.

The nozzle having the exemplary arrangement further includes a nozzle body having first and second surfaces, a first end plate coupled to the nozzle body proximate the first surface, and a second end plate coupled to the nozzle body proximate the second surface. The first plurality of air passages is defined between the first surface of the nozzle body and the first end plate. The second plurality of air passages is defined between the second surface of the nozzle body and the second end plate. Additionally, the liquid outlets are arranged in a row defined between the first and second surfaces. In this exemplary embodiment of the nozzle, the first and second pluralities of air passages are thus respectively located on opposite sides of a plane including the row of liquid outlets.

A method of dispensing multiple adhesive filaments onto a substrate in a random pattern using asymmetrical pressurized process air is also provided. The method generally comprises moving the substrate along a machine direction and discharging multiple adhesive filaments from a plurality of liquid outlets. Pressurized process air is directed toward each one of the multiple adhesive filaments respectively along a first angle relative to a plane including the associated liquid outlet. Pressurized process air is also directed toward each one of the multiple adhesive filaments respectively along a second angle relative to the plane including the associated liquid outlet and on an opposite side of the associated liquid outlet than the pressurized process air directed along the first angle. The second angle is different than the first angle so that the pressurized process air is directed asymmetrically toward the multiple adhesive filaments.

The method also comprises forming zones of air turbulence below the liquid outlets with the pressurized process air directed toward the multiple adhesive filaments. The multiple adhesive filaments are directed through the zones of turbulence and moved back and forth primarily in the machine direction; (there is also some secondary movement in a cross-machine direction). Thus, eventually the multiple adhesive filaments are deposited on the substrate in a random pattern generally along the machine direction.

In one embodiment, the multiple adhesive filaments discharging from the row of liquid outlets are discharged from liquid slots contained in an adhesive shim plate. Additionally, the pressurized process air directed toward the multiple adhesive filaments along the first angle is directed from air slots contained in a first air shim plate and the pressurized process air directed toward the multiple adhesive filaments along the second angle is directed from air slots contained in a second air shim plate. Each of the liquid slots in the adhesive shim plate is arranged generally between a pair of air slots in the first air shim plate and a pair of air slots in the second air shim plate thereby associating four air slots with each liquid slot. The zone of turbulence is thus formed by pressurized process air directed by the associated group of four air slots.

The pressurized process air is directed differently in other embodiments. For example, in another embodiment, pressurized process air is directed toward the liquid outlets of the nozzle from first and second pluralities of air passages. Each of the liquid outlets is arranged generally between one of the first plurality of air passages and a pair of the second plurality of air passages. Thus, three air passages direct the pressurized process air toward each of the adhesive filaments.

In another embodiment, each of the liquid outlets is arranged generally between one the first plurality of air passages and one of the second plurality of air passages. Thus, two air passages direct pressurized process air asymmetrically toward each of the adhesive filaments. The first and second pluralities of air passages and the liquid outlets are either configured in series or configured in rows.

DETAILED DESCRIPTION

Figure 1:
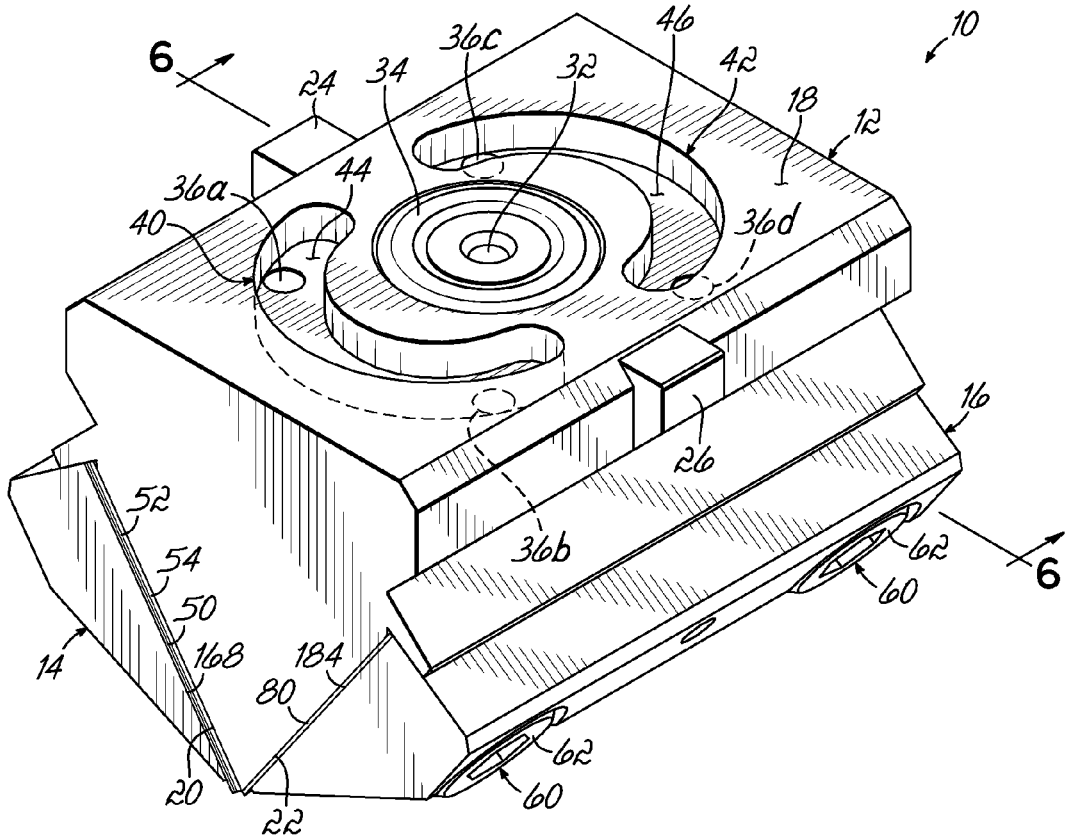
FIG. 1 is an assembled perspective view of one embodiment of a nozzle.
Figure 2:
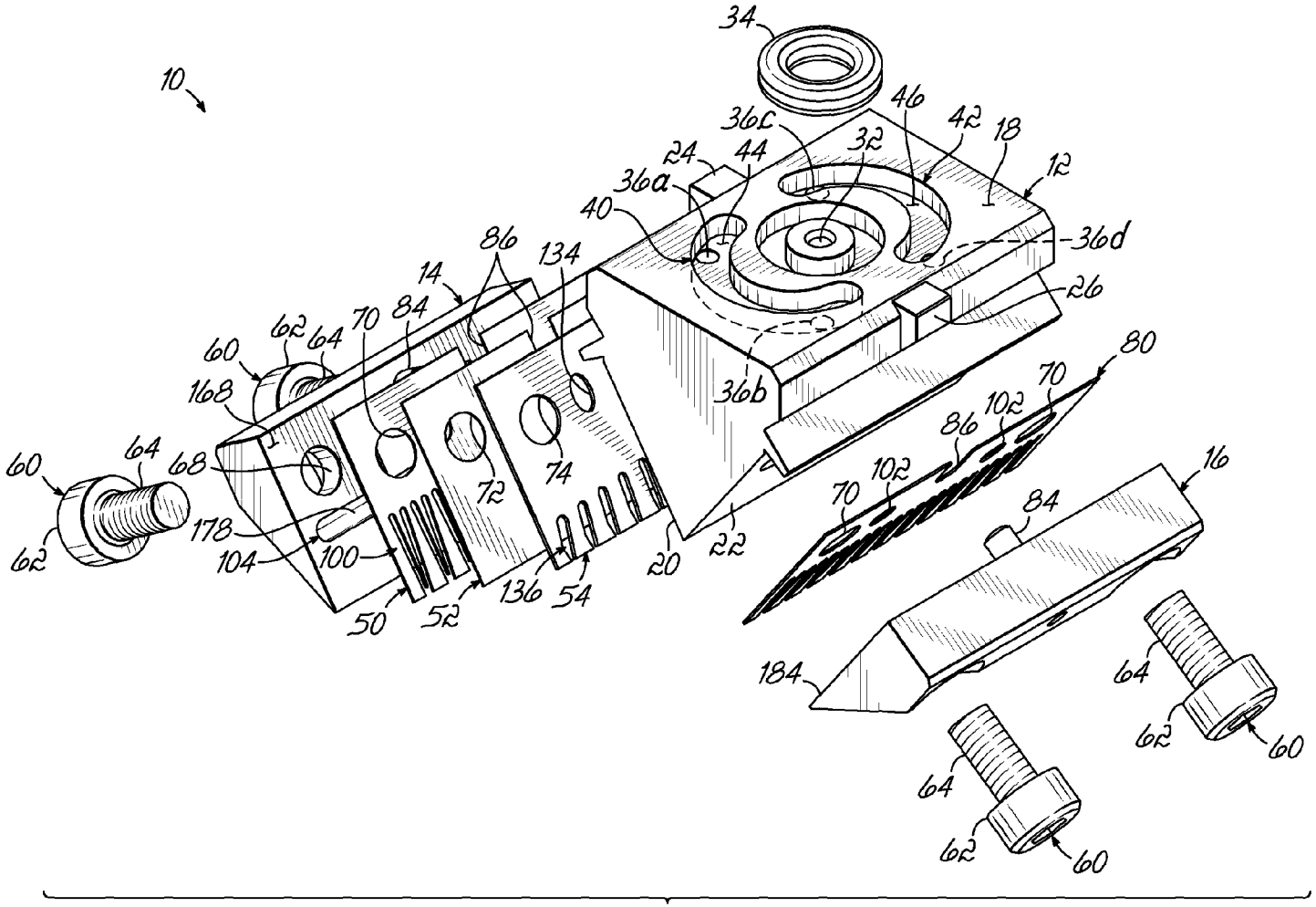
FIG. 2 is a disassembled perspective view of the nozzle shown in FIG. 1.

FIGS. 1 and 2 illustrate one embodiment of a nozzle 10 for dispensing a random pattern of liquid adhesive filaments (not shown). As will be described in greater detail below, nozzle 10 is constructed so that pressurized process air is directed at the liquid adhesive filaments in an asymmetrical manner. This general principle may be incorporated into a wide variety adhesive dispensing systems. Thus, although the construction of nozzle 10 will be described in considerable detail, those of ordinary skill in the art will appreciate that nozzle 10 is merely one example of how components may be arranged or a solid nozzle drilled to achieve the asymmetrical arrangement described below.

Nozzle 10 comprises a nozzle body 12 and first and second end plates 14, 16 secured to nozzle body 12. Nozzle body 12 has a generally triangular, or wedge-shaped, cross-sectional configuration with first and second surfaces 20, 22 generally converging toward each other and a top surface 18 extending between first and second surfaces 20, 22. Lateral projections 24, 26 on opposite sides of top surface 18 are used to secure nozzle 10 to a dispensing valve or module (not shown), as further shown and described in U.S. Pat. No. 6,676,038, the disclosure of which is incorporated herein by reference.

Nozzle body 12 further includes a liquid inlet 32 provided in top surface 18 for receiving pressurized liquid adhesive when nozzle 10 is secured to the dispensing valve or module. A seal member 34 is provided around liquid inlet 32 to prevent leakage between these components. Top surface 18 also has a plurality of process air inlets 36*a*, 36*b*, 36*c*, 36*d* for receiving pressurized process air. FIGS. 1 and 2 illustrate process air inlets 36*a*, 36*b*, 36*c*, 36*d* being formed in first or second arcuate channels 40, 42 on opposite sides of liquid inlet 32. More specifically, first and second process air inlets 36*a*, 36*b* are provided in a bottom surface 44 of first arcuate channel 40, and third and fourth process air inlets 36*c*, 36*d* are provided in a bottom surface 46 of second arcuate channel 42. First and second arcuate channels 40, 42 help evenly distribute pressurized process air directed at top surface 18 to the respective process air inlets 36*a*, 36*b*, 36*c*, 36*d*.

In one embodiment, first end plate 14 is secured to first surface 20 of nozzle body 12 and second end plate 16 is secured to second surface 22 of nozzle body 12. A first air shim plate 50, a separating shim plate 52, and an adhesive shim plate 54 are positioned between first end plate 14 and first surface 20. Although first air shim 50 is described below serving to direct pressurized process air, it will be appreciated that grooves (not shown) or the like may be provided in first end plate 14 for this purpose in alternative embodiments. First air shim plate 50, separating shim plate 52, and adhesive shim plate 54 are coupled to first surface 20 so as to be arranged substantially parallel thereto. Threaded fasteners 60 are used to clamp first air shim plate 50, separating shim plate 52, and adhesive shim plate 54 between first end plate 14 and first surface 20. To this end, each threaded fastener 60 includes an enlarged head 62 retained against first end plate 14 and a shaft 64 that extends through aligned holes 68, 70, 72, 74 (in first end plate 14, first air shim plate 50, separating shim plate 52, and adhesive shim plate 54, respectively) before engaging a tapped hole (not shown) in first surface 20.

Second endplate 16 is clamped or otherwise secured to second surface 22 in substantially the same manner as first end plate 14 and first surface 20, but with a second air shim plate 80 positioned therebetween. Thus, second air shim plate 80 may be coupled to second surface 22 so as to be arranged substantially parallel thereto. Second air shim plate 80 is described below as serving to direct pressurized process air, but, like first end plate 14, second end plate 16 may be provided with grooves (not shown) or the like for this purpose in alternative embodiments. Thus, in some alternative embodiments, both first end plate 14 and second end plate 16 direct pressurized process air instead of first and second air shim plates 50, 80.

Referring back to the embodiment shown in FIGS. 1 and 2, both first end plate 14 and second end plate 16 further include a projection or locating member 84 that helps properly position first and second end plates 14, 16, first and second air shim plates 50, 80, separating shim plate 52, and adhesive shim plate 54 relative to nozzle body 12. To this end, locating member 84 of first end plate 14 extends through respective upper slots 86 in first air shim plate 50, separating shim plate 52, and adhesive shim plate 54 (FIG. 5) before being received in a blind bore 88 (FIG. 6) in first surface 20. Similarly, locating member 84 of second end plate 16 extends through upper slot 86 in second air shim plate 80 before being received in a blind bore 90 (FIG. 6) in second surface 22.

Figure 3:
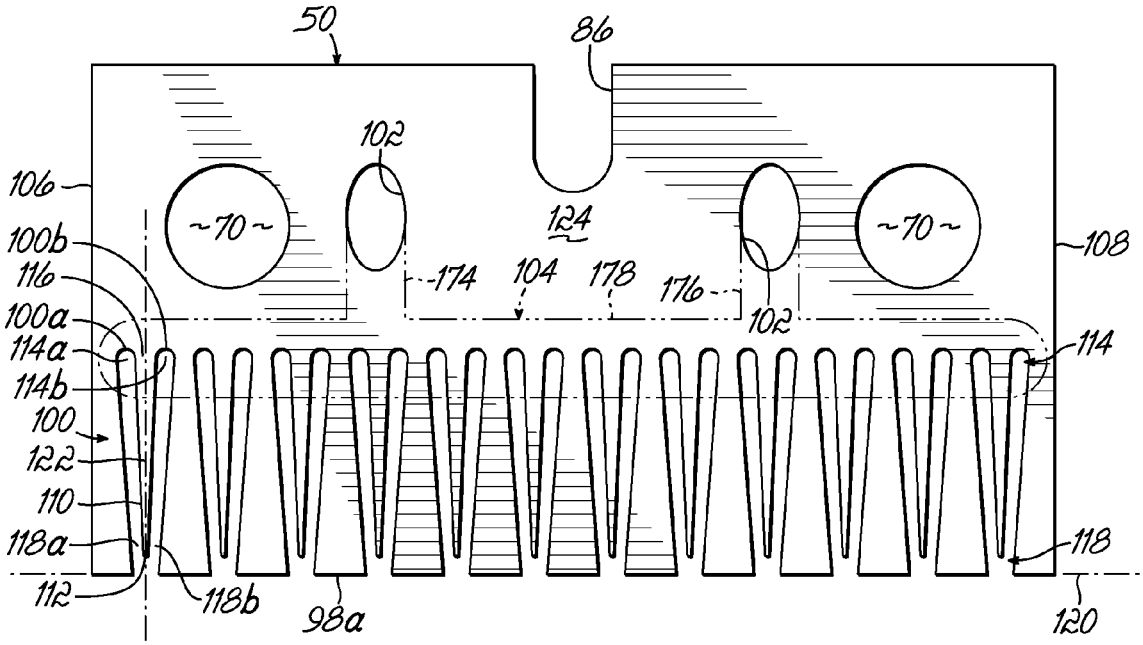
FIG. 3 is a front elevational view of a first air shim plate incorporated into the nozzle of FIG. 1.

FIG. 3 illustrates first air shim plate 50 in further detail. First air shim plate 50 and second air shim plate 80 may have substantially the same construction so as to be interchangeable, such that the following description applies equally to second air shim plate 80. As shown in FIG. 3, first air shim plate 50 includes a bottom edge 98*a* and a plurality of air slots 100 extending from bottom edge 98*a*. First air shim plate 50 also includes holes 102 so that pressurized process air can be directed from nozzle body 12 to a distribution channel 104 in first end plate 14. As will be described in greater detail below, air slots 100 are adapted to receive and direct the pressurized process air from first end plate 14.

In one embodiment, air slots 100 are arranged in pairs between opposed ends 106, 108 of first air shim plate 50. Air slots 100*a*, 100*b* of each pair may converge toward each other as they extend toward bottom edge 98*a*. Tapered members 110 on first air shim plate 50 are defined between air slots 100*a*, 100*b* of each pair. The air slots 100*a*, 100*b* include respective air inlets 114*a*, 114*b* defined near a base portion 116 of the associated tapered member 110 and respective air outlets 118*a*, 118*b* defined between bottom edge 98*a* and a terminating end 112 of the associated tapered member 110. The air slots 100*a*, 100*b* themselves taper so that their widths are greater at the respective air inlets 114*a*, 114*b* than at the respective air outlets 118*a*, 118*b*. However, the air slots 100*a*, 100*b* may alternatively be designed without a taper so as to have a substantially uniform width. Terminating ends 112 of tapered members 110 are spaced from a plane 120 including bottom edge 98*a*. In other embodiments, terminating ends 112 may be substantially flush with or extend beyond plane 120.

Although centerlines 122 between the converging air slots 100*a*, 100*b* of each pair are shown as being substantially perpendicular to bottom edge 98*a*, air slots 100*a*, 100*b* may alternatively be arranged so that centerlines 122 are positioned at an angle relative to bottom edge 98*a*. For example, air slots 100*a*, 100*b* of each pair may be arranged so that centerlines 122 progressively angle outwardly from a central portion 124 of first air shim plate 50 toward opposed ends 106, 108. Such an arrangement is disclosed in U.S. patent application Ser. No. 11/610,148, the disclosure of which is incorporated by reference herein in its entirety.

Figure 4:
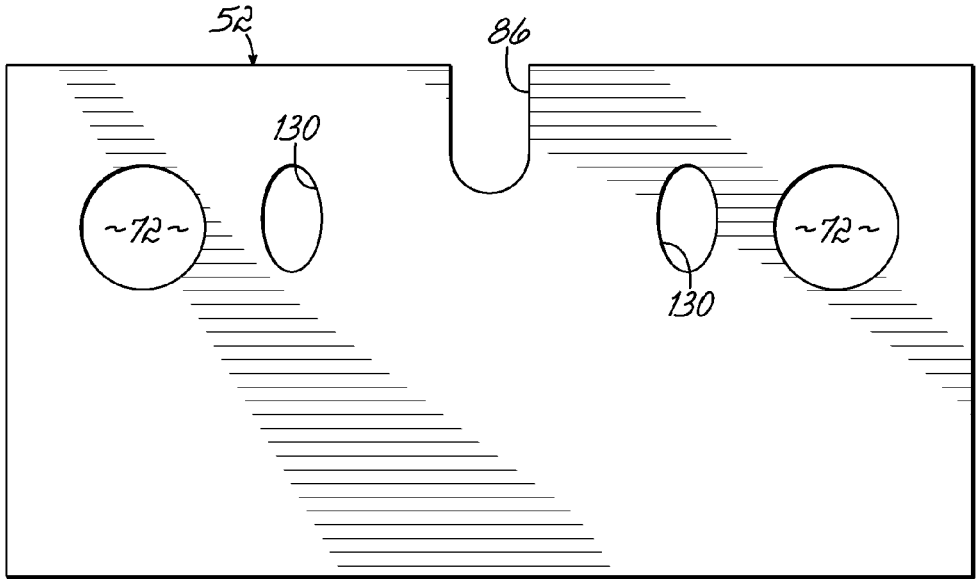
FIG. 4 is a front elevational view of a separating shim plate incorporated into the nozzle of FIG. 1.

As shown in FIG. 4, separating shim plate 52 includes holes 130 configured to be aligned with holes 102 (FIG. 3) in first air shim plate 50. Separating shim plate 52 is generally rectangular and serves as a spacer between first air shim plate 50 and adhesive shim plate 54. Those skilled in the art will appreciate that any number of separating shim plates 52 may be positioned between first air shim plate 50 and adhesive shim plate 54.

Figure 5:
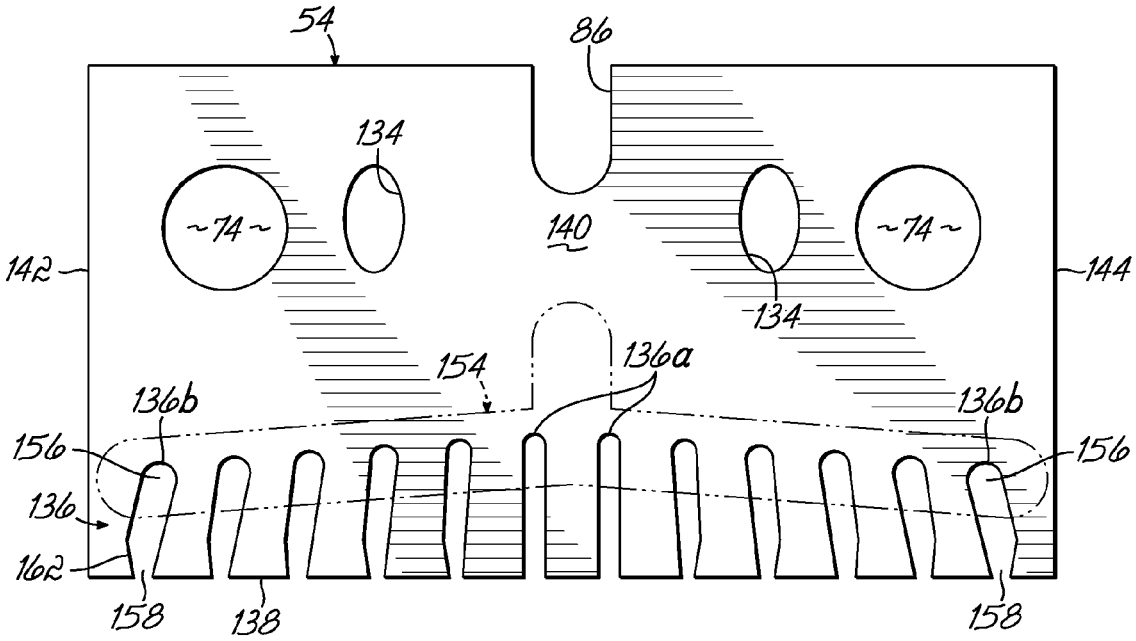
FIG. 5 is a front elevational view of an adhesive shim plate incorporated into the nozzle of FIG. 1.

FIG. 5 illustrates adhesive shim plate 54 in further detail. Similar to separating shim plate 52, adhesive shim plate 54 includes holes 134 configured to be aligned with holes 102 (FIG. 3) in first air shim plate 50. Adhesive shim plate 54 also includes a plurality of liquid slots 136 extending from a bottom edge 138 between opposed ends 142, 144. Liquid slots 136 may vary in length and angle outwardly in a progressive manner from a central portion 140 of adhesive shim plate 54 toward opposed ends 142, 144. Liquid slots 136 may also vary in width and height depending on their position on adhesive shim plate 54. For example, liquid slots 136*a* proximate central portion 140 may have a first height and first width, whereas liquid slots 136*b* proximate ends 142, 144 may have a second height less than the first height and a second width greater than the first width. Increasing the width of liquid slots 136 in increments based on their distance from central portion 140 has particular advantages, as will be described in greater detail below.

In addition to varying in width relative to other liquid slots 136, each liquid slot 136 may itself vary in width along its length. For example, each liquid slot 136 includes a liquid inlet 156 and a liquid outlet 158. The liquid slots 136 may extend between the associated liquid inlets 156 and liquid outlets 158 with a substantially uniform width, as evidenced by liquid slots 136*a*, or with a width that narrows near the associated liquid outlet 158, as evidenced by liquid slots 136*b*. To this end, several or all of liquid slots 136 may include a generally V-shaped, converging portion 162 adjacent to the associated liquid outlet 158.

Figure 6:
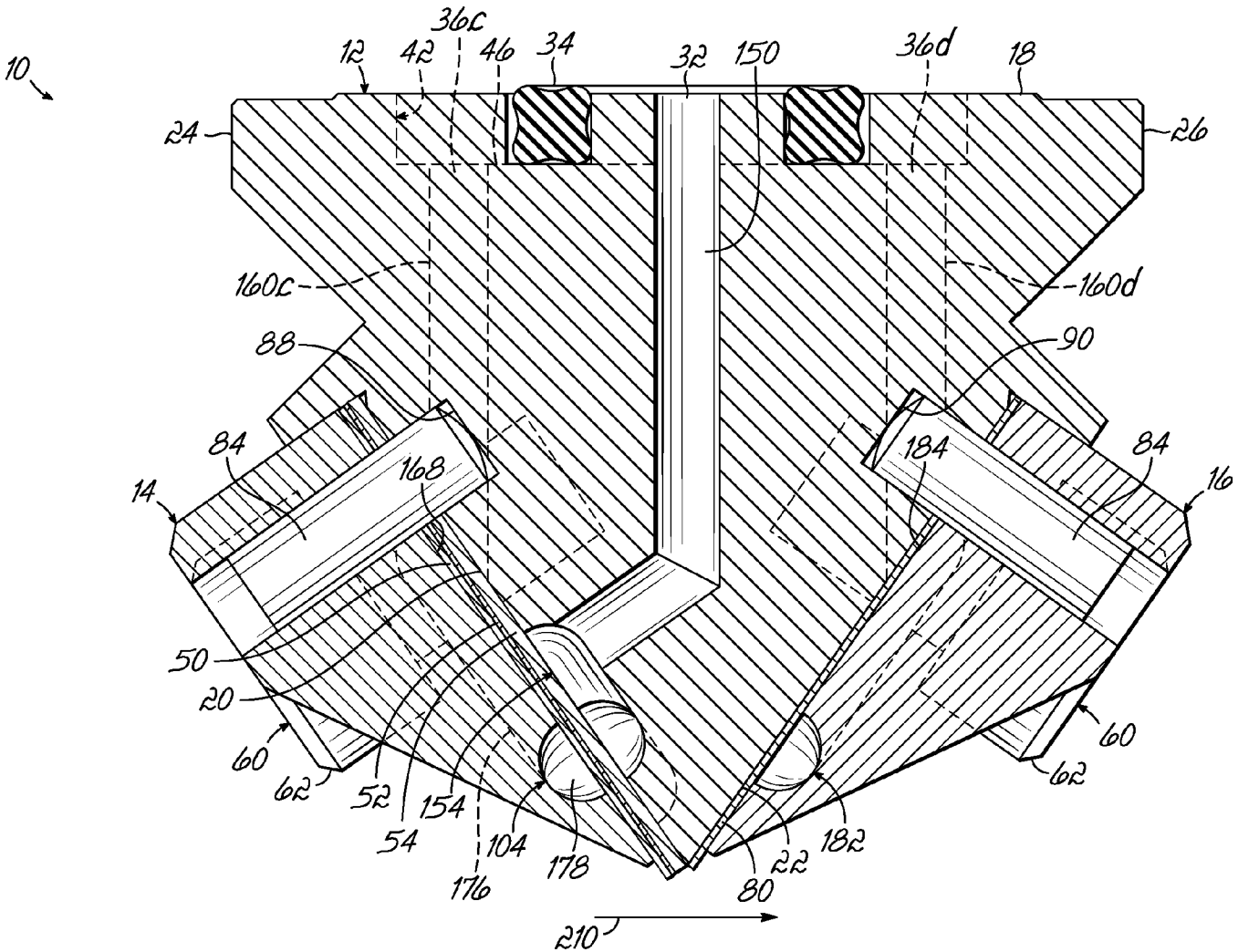
FIG. 6 is a cross sectional view taken along line 6-6 in FIG. 1.

Now referring to FIGS. 5 and 6, adhesive shim plate 54 is configured to receive pressurized liquid adhesive from nozzle body 12 when nozzle 10 is assembled. More specifically, nozzle body 12 includes a liquid supply passage 150 that communicates pressurized liquid adhesive from liquid inlet 32 to a distribution channel 154 defined in first surface 20. A portion of distribution channel 154 extends across first surface 20 proximate liquid inlets 156 of liquid slots 136. Thus, pressurized liquid adhesive communicated to distribution channel 154 enters liquid slots 136 through liquid inlets 156 and is directed toward bottom edge 138. The pressurized liquid adhesive is ultimately discharged from each liquid slot 136 through the associated liquid outlet 158 as a filament of adhesive material.

Advantageously, the varying widths of liquid slots 136 helps maintain a substantially uniform distribution of the pressurized liquid adhesive discharged through liquid outlets 158 across bottom edge 138. For example, when the pressurized liquid adhesive is supplied to nozzle body 12, portions of distribution channel 154 near opposed ends 142, 144 of adhesive shim plate 54 may experience greater back pressures than portions of distribution channel 154 confronting central portion 140 of adhesive shim plate 54. Increasing the width of liquid slots 136*b* accommodates the increased back pressure so that the pressurized liquid adhesive is discharged from liquid slots 136*b* (through the associated liquid outlets 158) at substantially the same flow rate as pressurized liquid adhesive discharged from liquid slots 136*a*.

Although not shown in detail, nozzle body 12 further includes air supply passages 160*a*, 160*b*, 160*c*, 160*d* for directing pressurized process air from process air inlets 36*a*, 36*b*, 36*c*, 36*d* to first surface 20 and second surface 22. There may be a separate air supply passage 160*a*, 160*b*, 160*c*, 160*d* for each process air inlet 36*a*, 36*b*, 36*c*, 36*d*. The air supply passages 160*a*, 160*c* are associated with process air inlets 36*a*, 36*c* and have respective process air outlets (not shown) formed in first surface 20. These outlets are aligned with holes 134 (FIGS. 2 and 5) in adhesive shim plate 54. As a result, pressurized process air communicated by air supply passages 160*a*, 160*c* is able to flow through holes 134 in adhesive shim plate 54, holes 130 in separating shim plate 52, and holes 102 in first air shim plate 50 before reaching first end plate 14.

First end plate 14 includes a distribution channel 104 (FIG. 2) formed on an inner surface 168 that confronts first air shim plate 50. Distribution channel 104 is configured to direct the pressurized process air to air inlets 114 (FIG. 3) of air slots 100. Distribution channel 104 may be similar to portions of the process air distribution system shown and described in U.S. patent application Ser. No. 11/610,148, which, as indicated above, is incorporated herein by reference. To this end, distribution channel 104 may include vertical recesses 174, 176 aligned with holes 102 and a horizontal recess 178 intersecting vertical recesses 174, 176 and extending across air inlets 114 of air slots 100.

Pressurized process air is directed to, and distributed by, second end plate 16 in a similar manner. For example, air supply passages 160*b*, 160*d* associated with process air inlets 36*b*, 36*d* have respective process air outlets (not shown) formed in second surface 22. These outlets are aligned with holes 102 in second air shim plate 80 so that the pressurized process air can flow to a distribution channel 182 formed on an inner surface 184 of second end plate 16. Distribution channel 182 may have a configuration similar to, or at least operating upon the same principles as, distribution channel 104.

Figure 7:
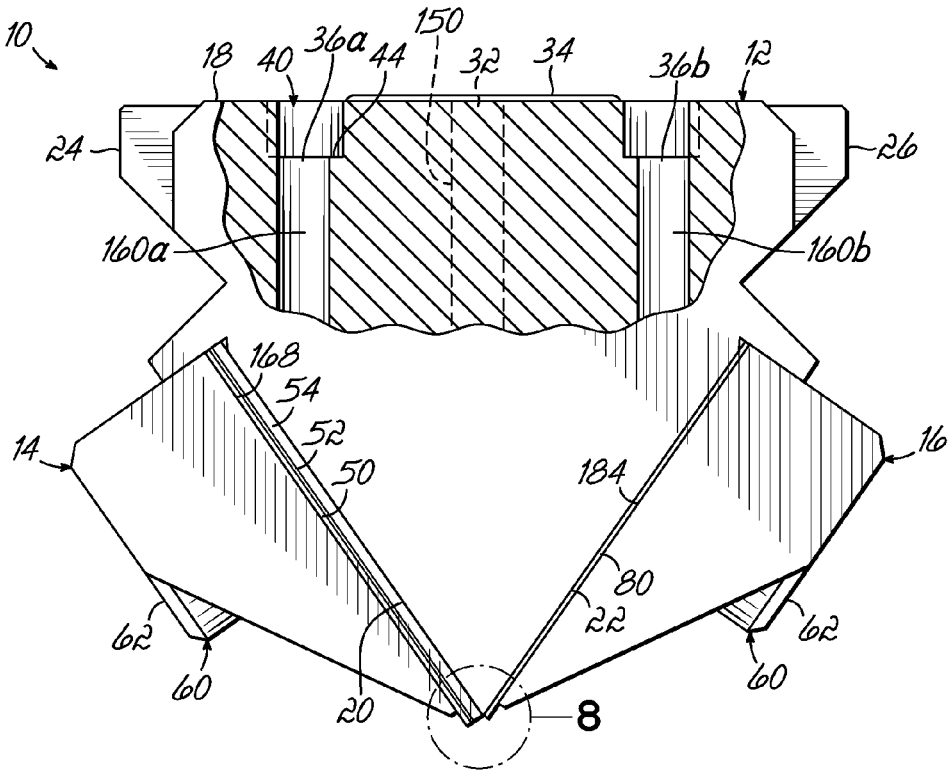
FIG. 7 is a side elevational view of the nozzle shown in FIG. 1.
Figure 8:
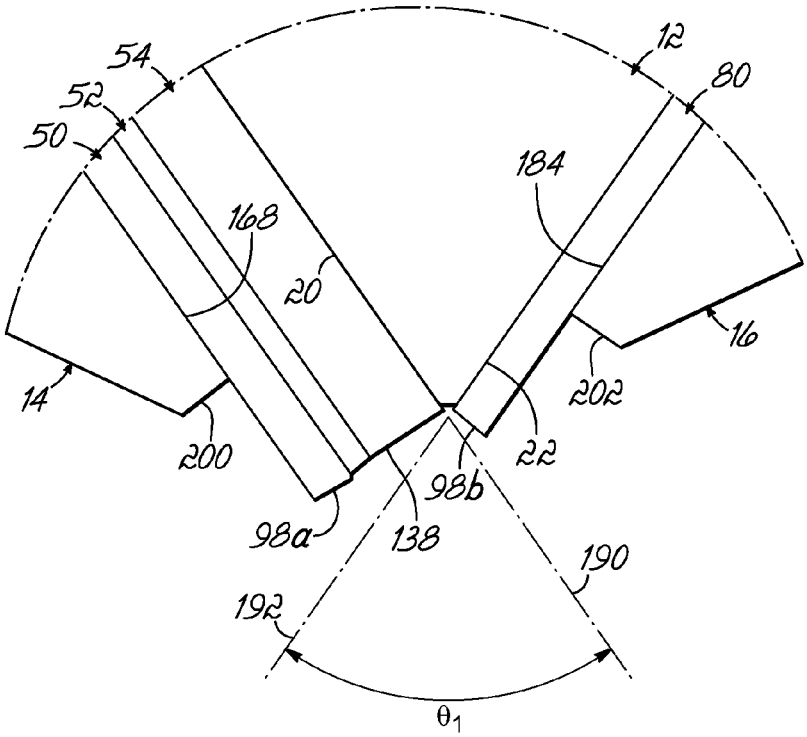
FIG. 8 is an enlarged view of the area circled in FIG. 7.

Now referring to FIGS. 7 and 8, in an assembled condition, first surface 20 of nozzle body 12 is aligned in a plane 190 and second surface 22 is aligned in a plane 192 positioned at an angle $\theta_1$ relative to plane 190. Because adhesive shim plate 54 is substantially parallel to first surface 20 and second air shim plate 80 is substantially parallel to second surface 22, second air shim plate 80 is positioned at angle $\theta_1$ relative to adhesive shim plate 54.

Figure 8A:
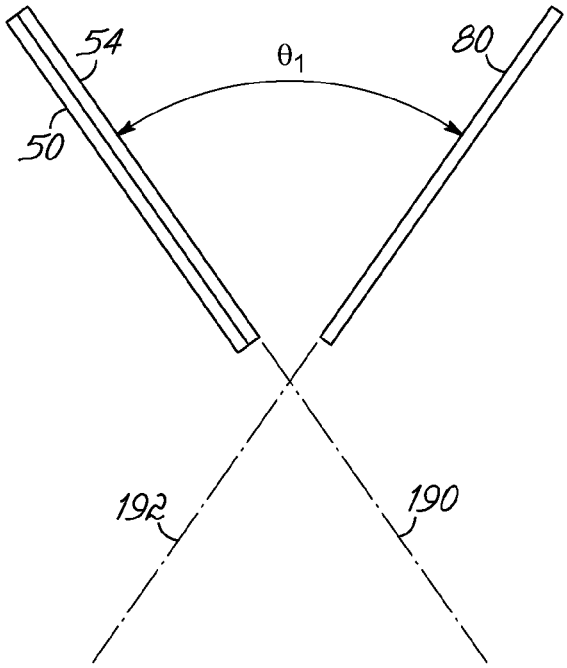
FIG. 8A is a diagrammatic view of the nozzle arrangement shown in FIG. 8.

Those skilled in the art will appreciate that first air shim plate 50 is also positioned at an angle relative to, but offset from, adhesive shim plate 54. For example, FIG. 8A is a diagrammatic view of the arrangement shown in FIG. 8 with this offset removed. The angular orientations of first air shim plate 50 and adhesive shim plate 54 are substantially the same (the angle of first air shim plate 50 relative to adhesive shim plate 54 is about 0°). Thus, in addition to being positioned at angle $\theta_1$ relative to adhesive shim plate 54, second air shim plate is positioned at angle $\theta_1$ relative to first air shim plate 50. Angle $\theta_1$ may vary depending on depending on the construction of nozzle 10 and its intended application. However, Applicants have found that a suitable range for angle $\theta_1$ in the exemplary embodiment shown is from about 40° to about 90°. In one particular embodiment, angle $\theta_1$ is about 70°.

Figure 8B:
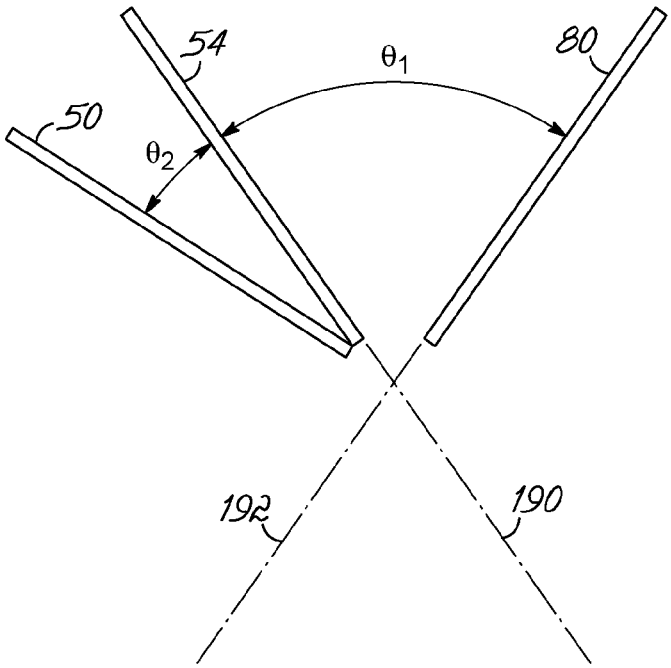
FIG. 8B is a diagrammatic view of a nozzle arrangement according to an alternative embodiment.

In alternative embodiments, first air shim plate 50 is not substantially parallel to adhesive shim plate 54. For example, FIG. 8B is a diagrammatic view of an arrangement where first air shim plate 50 is inclined at an angle $\theta_2$ relative to adhesive shim plate 54. Such an arrangement may be achieved by positioning a wedge-shaped separating shim plate (not shown) or other similarly-shaped component between first air shim plate 50 and adhesive shim plate 54. Angle $\theta_2$, like angle $\theta_1$, may vary depending on the construction of the nozzle and its intended application. Advantageously, however, angle $\theta_2$ is different than angle $\theta_1$ such that first air shim plate 50 and second air shim plate 80 are angled asymmetrically relative to adhesive shim plate 54. Additionally, first air shim plate 50 may be offset so that it is aligned in a plane (not shown) that intersects plane 190 at substantially the same location as plane 192.

FIGS. 7 and 8 also illustrate the relative positions of adhesive shim plate 54, first and second air shim plates 50, 80, and first and second end plates 14, 16 when nozzle 10 is assembled. First air shim plate 50 extends beyond first end plate 14 such that the associated bottom edge 98*a* is spaced from a bottom edge 200 of first end plate 14. Bottom edge 98*a* also projects slightly beyond bottom edge 138 of adhesive shim plate 54. Similarly, second air shim plate 80 extends beyond second end plate 16 such that the associated bottom edge 98*b* is spaced from a bottom edge 202 of second end plate 16. Because of this arrangement, bottom edges 200, 202 extend across portions of air slots 100 (FIG. 3) in the associated first and second air shim plates 50, 80. The position of bottom edges 200, 202 approximately corresponds to terminating ends 112 of tapered members 110.

Figure 9:
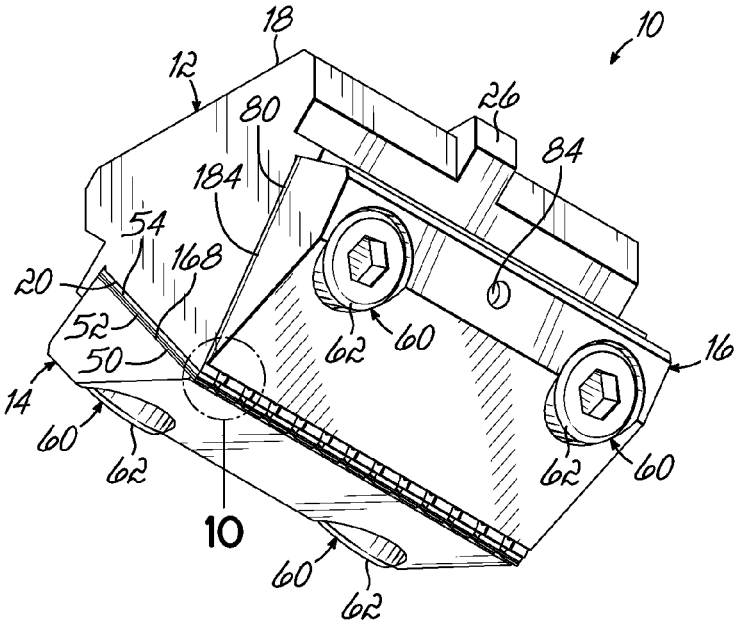
FIG. 9 is another assembled perspective view of the nozzle shown in FIG. 1.
Figure 10:
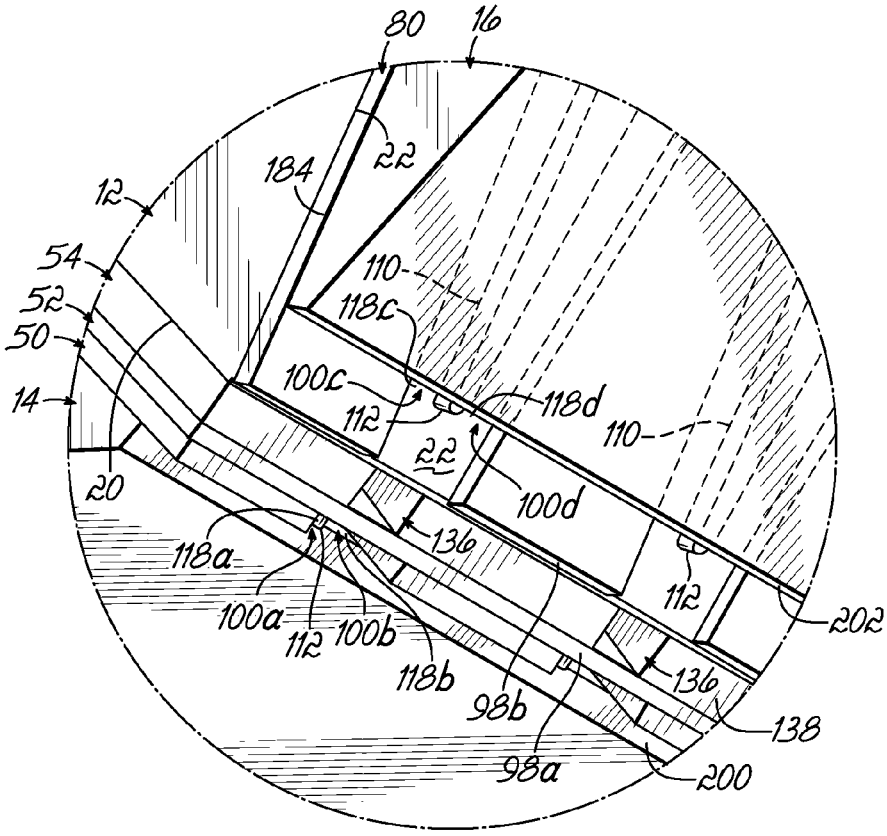
FIG. 10 is an enlarged view of the area circled in FIG. 9.

For example, as shown in FIGS. 9 and 10, second air shim plate 80 is positioned between second surface 22 and second end plate 16 such that terminating ends 112 extend slightly beyond bottom edge 202. First air shim plate 50 and first end plate 14 are arranged in a similar manner. Each air slot 100 defines an air passage extending from the associated air inlet 114 (FIG. 3) to the associated air outlet 118 for directing pressurized process air toward one or more of the liquid outlets 158.

Figure 12:
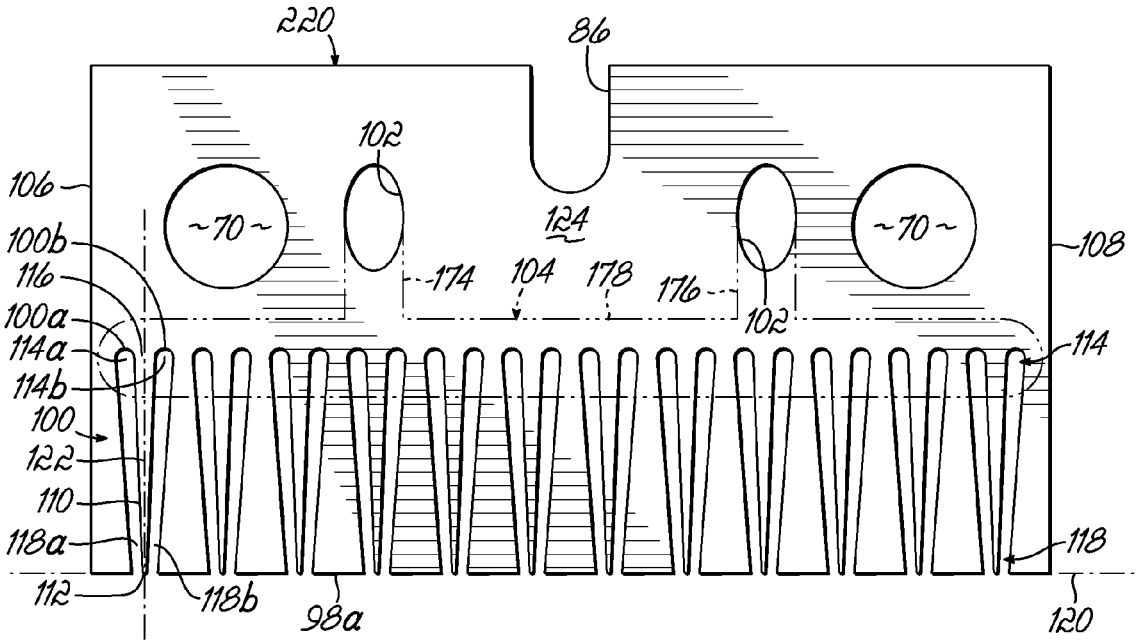
FIG. 12 is a front elevational view of a third air shim plate that may be incorporated into the nozzle of FIG. 1.
Figure 13:
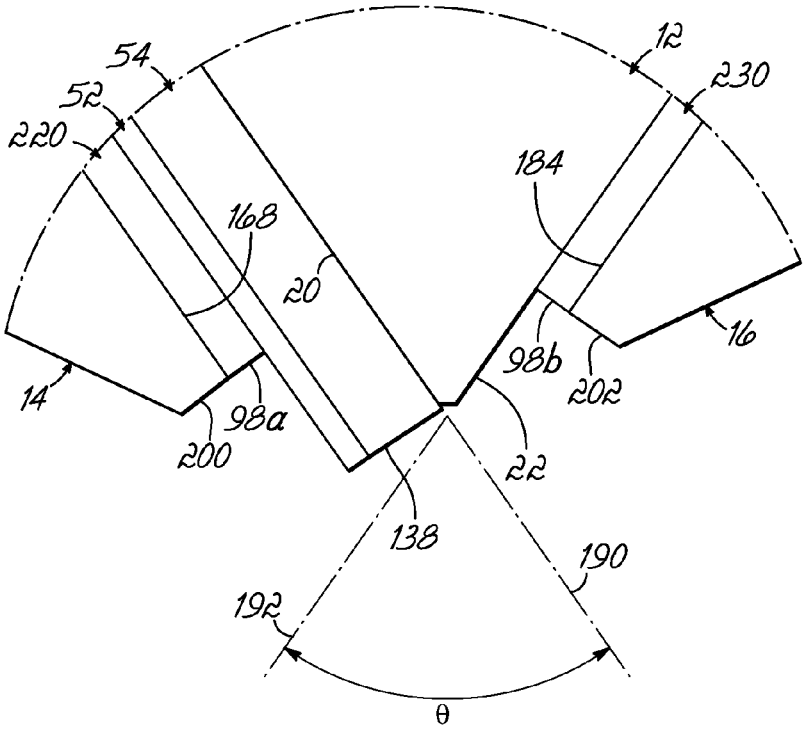
FIG. 13 is a view similar to FIG. 8, but showing an alternative embodiment of the nozzle that incorporates the third air shim plate of FIG. 12.

In an alternative embodiment, one or both of first and second air shim plates 50, 80 may be positioned so that their associated bottom edge 98*a*, 98*b* is substantially flush with bottom edge 200 of first end plate 14 or bottom edge 202 of second end plate 16. First and second shim plates 50, 80 may also be designed so that terminating ends 112 of tapered members 110 are substantially aligned with the associated bottom edge 98*a*, 98*b* in plane 120 (FIG. 3). For example, FIG. 12 illustrates a third air shim plate 220 having such a construction, with like reference numbers being used to refer to like structure from first air shim plate 50. Thus, third air shim plate 220 still includes converging pairs of air slots 100*a*, 100*b* having respective air inlets 114*a*, 114*b* and respective air outlets 118*a*, 118*b*. FIG. 13 illustrates how third air shim plate 220 may be positioned relative to adhesive shim plate 54 and first end plate 14 when substituted for first air shim plate 50 in nozzle 10. A fourth air shim plate 230 having substantially the same construction as third air shim plate 220 may be substituted for second air shim plate 80 (FIG. 8). Fourth air shim plate 230 may be positioned relative to second end plate 16 in substantially the same way that third air shim plate 220 is positioned relative to first end plate 14.

Figure 11:
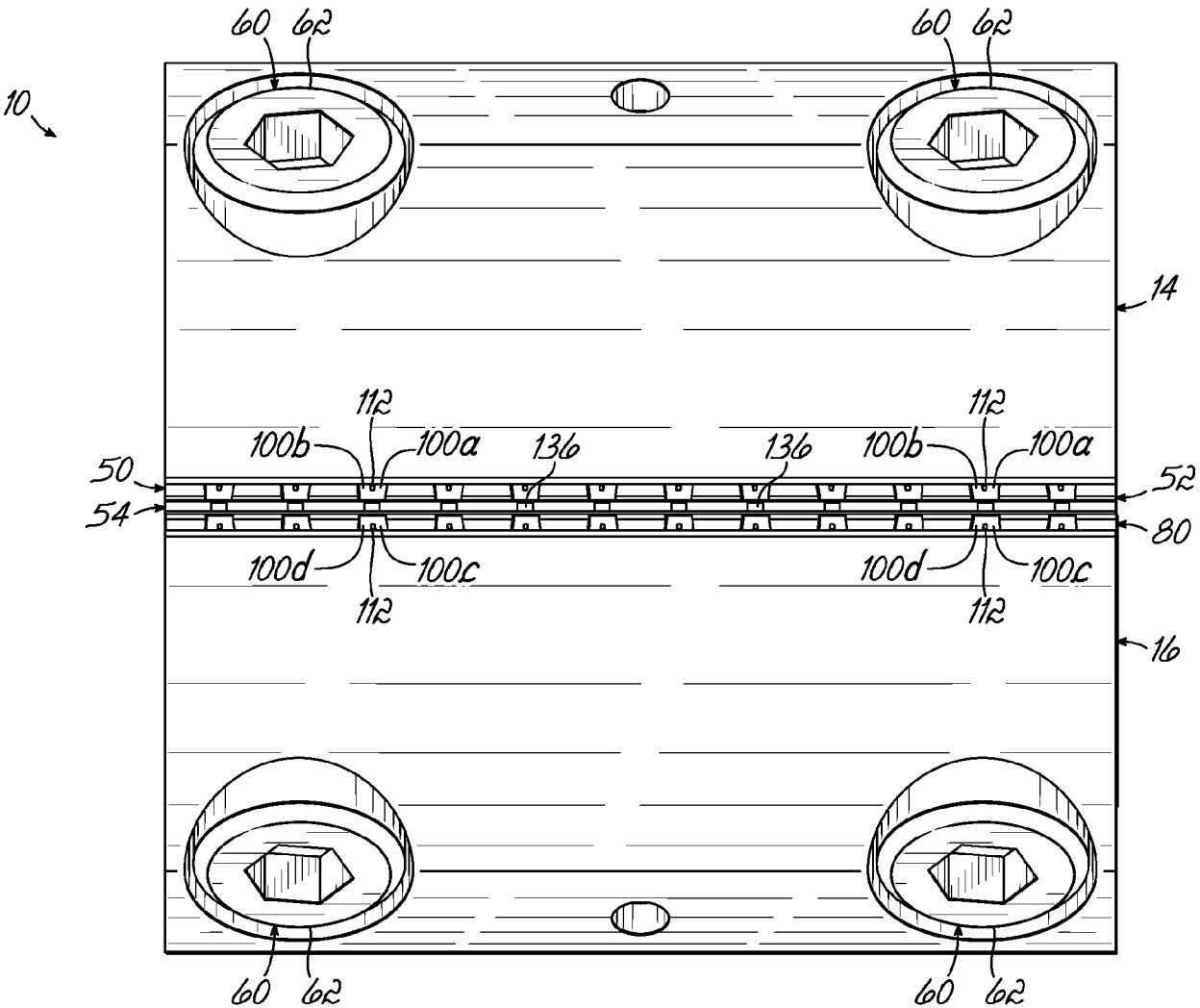
FIG. 11 is a bottom view of the nozzle shown in FIG. 1.
Figure 11A:
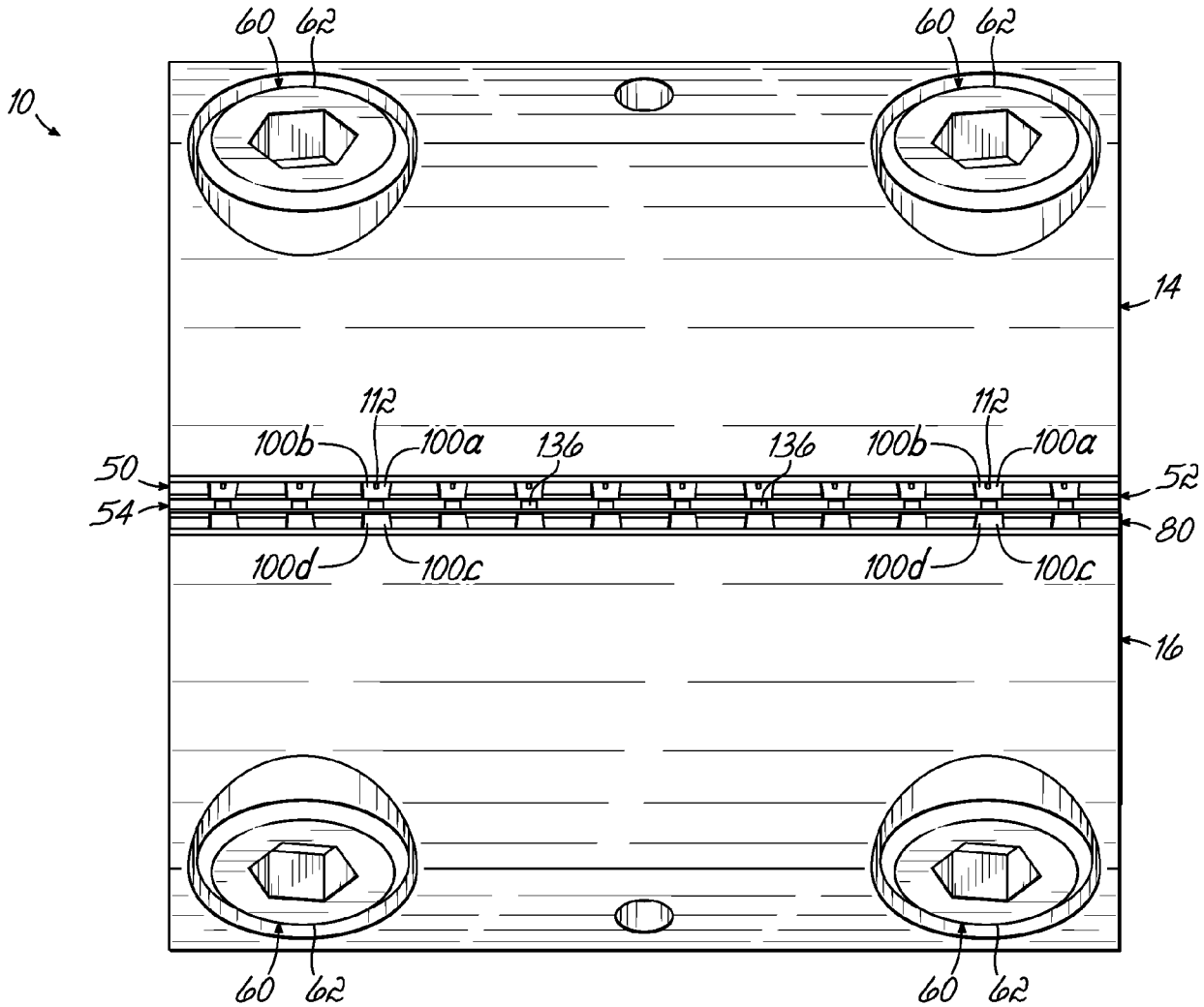
FIG. 11A is a bottom view of an alternative embodiment of the nozzle as shown in FIG. 11.
Figure 11B:
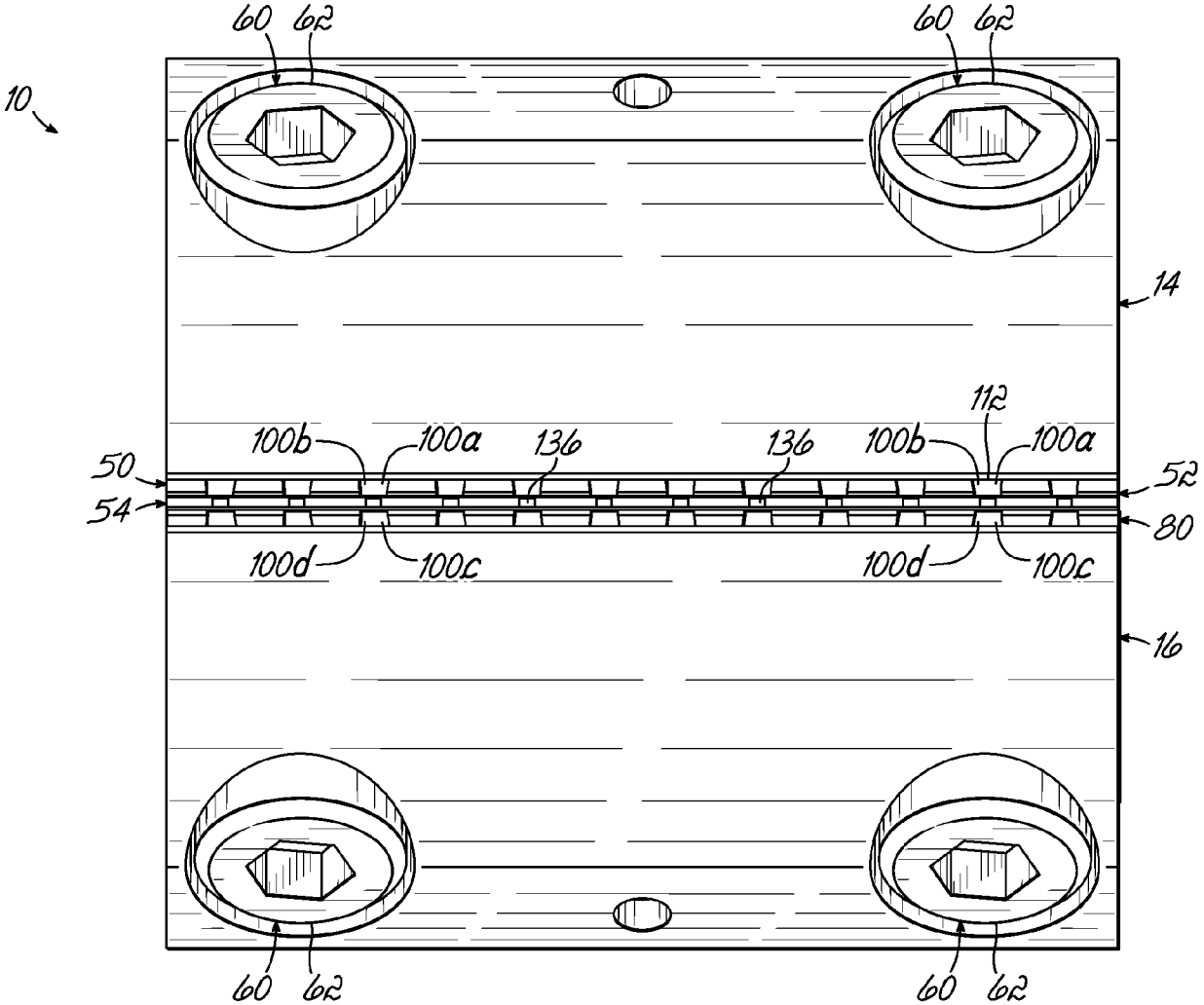
FIG. 11B is a bottom view of another alternative embodiment of the nozzle shown in FIG. 11.

Nozzle 10 operates upon similar principles regardless of whether third and fourth air shim plates 220, 230 are substituted for first and second air shim plates 50, 80. Referring back to the embodiment shown in FIG. 10, adhesive shim plate 54 is positioned so that each liquid slot 136 is arranged generally between a pair of air slots 100*a*, 100*b* in first air shim plate 50 and a pair of air slots 100*c*, 100*d* in second air shim plate 80. As a result, four air slots 100*a*, 100*b*, 100*c*, 100*d* (and their corresponding air passages and air outlets 118*a*, 118*b*, 118*c*, 118*d*) are associated with each liquid slot 136 (and the corresponding liquid outlet 158). FIG. 11 illustrates this aspect in further detail, with air outlets 118 and liquid outlets 158 not being labeled for clarity. FIG. 11A shows an alternative embodiment in which the nozzle 10 is constructed as previously described, except that the tapered members 110 have been removed in the first air shim plate 50. Thus, three air slots are associated with each liquid outlet. Of course, the three air slot design may be accomplished by removing the tapered members 110 from the second air shim plate 80 instead. FIG. 11B illustrates yet another embodiment of the nozzle 10 which is constructed as previously described, except that the tapered members 110 are removed from both the first and second air shim plates 50, 80. Thus, in this embodiment, two air slots or passages are associated with each liquid slot.

Thus, during a dispensing operation, pressurized liquid adhesive is supplied to liquid inlets 156 of liquid slots 136 in adhesive shim plate 54 as described above. Liquid slots 136 discharge the pressurized liquid adhesive through liquid outlets 158 as adhesive filaments. The adhesive filaments are discharged at a slight angle in the machine direction 210 (FIG. 6) of a substrate (not shown) moving past nozzle 10 due to the arrangement of nozzle 10 relative to the machine direction 210. At the same time, pressurized process air is supplied to air inlets 114 of air slots 100 in first and second air shim plates 50, 80. The air passages defined by air slots 100 direct the pressurized process air toward the adhesive filaments being discharged from liquid slots 136. Each group of four air slots 100*a*, 100*b*, 100*c*, 100*d* forms a zone of turbulence below the associated liquid slot 136 for moving the filaments back and forth in random directions. For example, the adhesive filaments are moved back and forth in both a "web-direction", i.e. substantially parallel to the machine direction 210, and a "cross-web" direction, i.e. substantially perpendicular to the machine direction 210. Most of the movement for nozzle 10 occurs in the web direction. As such, eventually the adhesive filaments are deposited on the substrate in a random pattern generally along the machine direction 210.

Applicants have found that by directing pressurized process air toward the adhesive filaments along different angles relative to a plane including liquid outlets 158, nozzle 10 can achieve improved intermittent performance. In particular, the asymmetrical arrangement allows the pressurized process air to quickly and effectively "break" the adhesive filaments between dispensing cycles to provide the deposited pattern with well-defined cut-off and cut-on edges. During dispensing cycles, however, the same velocity of pressurized process air randomly moves the adhesive filaments back and forth without breaking them. Undesirable side effects (e.g., "fly") often associated with the velocities required to provide well-defined cut-off and cut-on edges may therefore be reduced or substantially eliminated.

Another feature that helps produce well-defined cut-off and cut-on edges is the arrangement of second air shim plate 80 relative to adhesive shim plate 54. More specifically, second air shim plate 80 is configured to direct pressurized process air immediately adjacent liquid outlets 158 (FIG. 5) because of angle $\theta_1$ (FIG. 8) and the proximity of bottom edge 98*b* to bottom edge 138. This arrangement allows the pressurized process air to strike the adhesive filaments as soon as they are discharged from liquid outlets 158. In conventional arrangements, the pressurized process air strikes the adhesive filaments at a location further removed from liquid outlets 158.

Those skilled in the art will appreciate that the arrangement of first and second air shim plates 50, 80 and adhesive shim plate 54 discussed above is merely one example of how the pressurized process air may be directed relative to the adhesive filaments. Thus, although first air shim plate 50 is shown and described as being parallel to (i.e., at a 0° angle relative to) adhesive shim plate 54, first air shim plate 50 may alternatively be positioned at different angles relative to adhesive shim plate 54. This may be accomplished using a wedge-shaped separating shim plate (not shown), as discussed above. An asymmetrical arrangement is maintained by keeping the angle of first air shim plate 50 relative to adhesive shim plate 54 different than the angle of second air shim plate 80 relative to adhesive shim plate 54.

In addition to the asymmetrical arrangement, the grouping of air slots 100 in pairs also enhances the ability of the pressurized process air to effectively attenuate and "break" the adhesive filaments between dispensing cycles. Two streams of pressurized process air are directed toward each side of the adhesive filaments to help achieve quick cut-off. However, it will be appreciated that one or both of the first and second air shim plates 50, 80 may alternatively be designed without air slots 100 arranged in pairs. For example, in an alternative embodiment not shown herein, one of the first or second air shim plates 50, 80 may be replaced with an air shim plate that does not include tapered members 112. Each air slot 100 in such an alternative air shim plate may be aligned with one of the liquid outlets 158 such that three air slots 100 (one from the alternative air shim plate and two from the remaining first or second air shim plate 50, 80) are associated with each liquid outlet 158. Such an arrangement allows the velocity of the pressurized process air directed at the adhesive filaments to be increased to achieve quick cut-off without undesirable side effects (e.g., fly) at higher dispensing pressures, flow rates, etc. of the adhesive. In other embodiments, both of the first and second air shim plates 50, 80 may be replaced with the alternative air shim plate described above.

Figure 14:
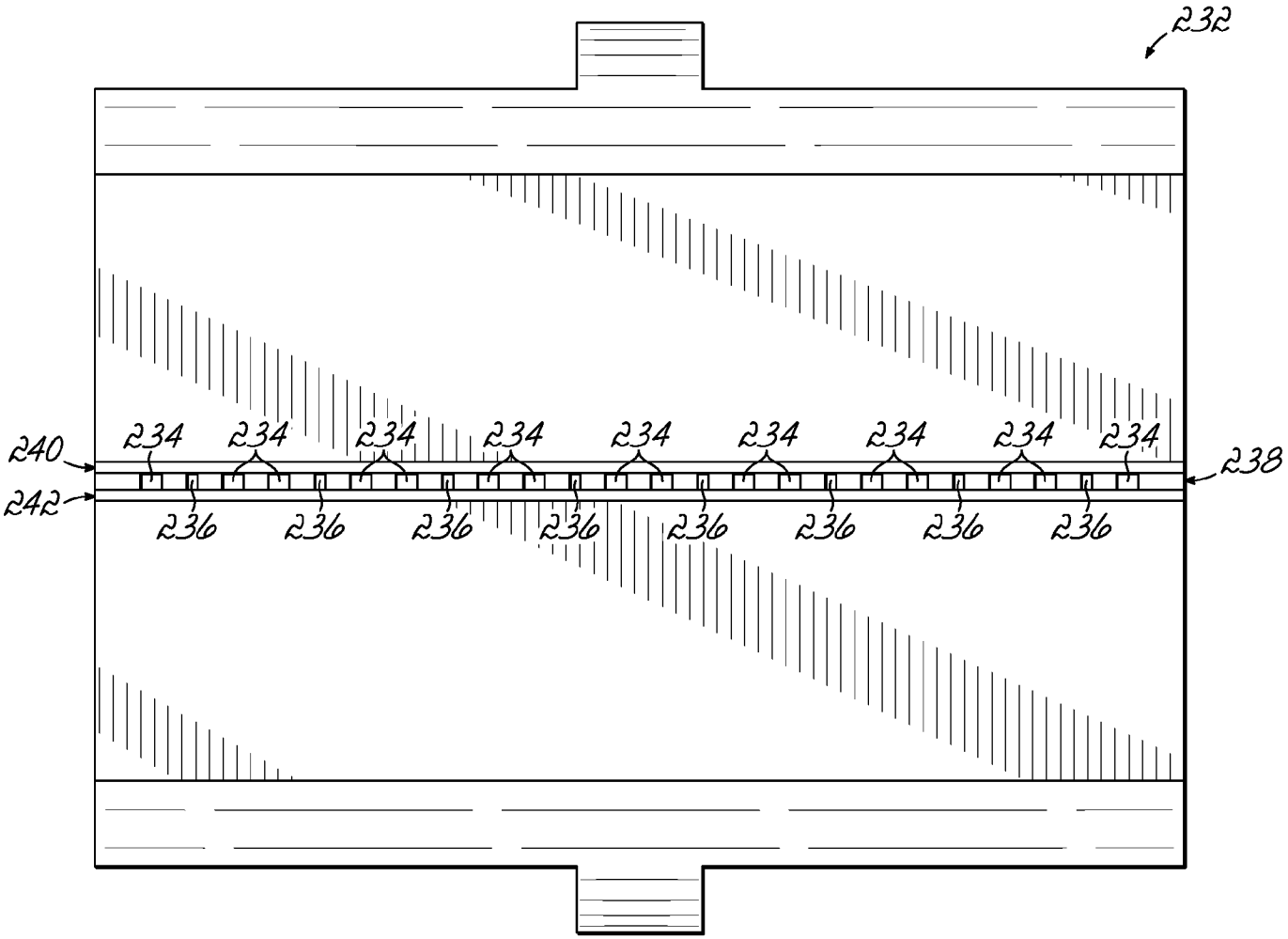
FIG. 14 is a bottom view of a nozzle constructed according to another embodiment in which the air slots and liquid slots of a nozzle plate are arranged in a series.

FIG. 14 is a bottom view illustrating another embodiment of a nozzle 232 comprised of a plurality of, for example, three plates. A plurality of slots forming a series of air outlets 234 and liquid outlets 236 are contained in a central plate 238. The air slots having outlets 234 are configured such that the air streams discharged from the air outlets 234 on opposite sides of each liquid outlet 236 are directed asymmetrically generally in the previously described manner. For example, the air stream discharged on one side of an adhesive filament being discharged from a liquid outlet 236 may be generally parallel to the filament discharge direction, while air discharged from an air outlet 234 on an opposite side of the liquid outlet 236 may be oriented at a greater angle toward the discharged filament. Outer plates 240, 242 sandwich central plate therebetween.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, although FIG. 6 illustrates one arrangement of nozzle 10 relative to machine direction 210, nozzle 10 could alternatively be arranged so that machine direction 210 is in an opposite direction (e.g., from right to left in FIG. 6). In such an embodiment, adhesive shim plate 54 discharges the adhesive filaments at a slight angle against the machine direction. The various aspects and features described herein may be used alone or in any combination depending on the needs of the user. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A nozzle for dispensing a random pattern of liquid adhesive filaments, comprising:

first and second air shim plates, said first and second air shim plates each having a plurality of air slots adapted to receive and direct pressurized process air; and an adhesive shim plate positioned between said first and second air shim plates, said adhesive shim plate having a plurality of liquid slots adapted to receive pressurized liquid adhesive and discharge liquid adhesive filaments, the pressurized process air directed by said air slots moves said filaments of the pressurized liquid adhesive discharging from said liquid slots in a random pattern;

said air slots in said first air shim plate are configured to direct the pressurized process air along a first angle relative to said adhesive shim plate and said air slots in said second air shim plate are configured to direct the pressurized process air along a second angle relative to said adhesive shim plate, said first angle being different than said second angle so that said first and second air shim plates direct the pressurized process air asymmetrically toward the adhesive filaments.

2. The nozzle of claim 1, wherein the first angle is about 0° such that said first air shim plate is substantially parallel to said adhesive shim plate.

3. The nozzle of claim 2, further comprising:

a separating shim plate positioned between said first air shim plate and said adhesive shim plate.

4. The nozzle of claim 2, wherein the second angle is from about 40° to about 90°.

5. The nozzle of claim 2, wherein the second angle is about 70°.

6. The nozzle of claim 1, further comprising:

a nozzle body, said first and second air shim plates and said adhesive shim plate being coupled to said nozzle body.

7. The nozzle of claim 6, wherein said nozzle body has first and second surfaces generally converging toward each other, said adhesive shim plate and said first air shim plate being coupled to said first surface so as to be arranged substantially parallel thereto, and said second air shim plate being coupled to said second surface so as to be arranged substantially parallel thereto.

8. The nozzle of claim 7, further comprising:

a separating shim plate positioned between said first air shim plate and said adhesive shim plate.

9. The nozzle of claim 7, further comprising:

a first end plate secured to said first surface of said nozzle body, said first air shim plate and said adhesive shim plate being positioned between said first end plate and said nozzle body; and a second end plate secured to said second surface of said nozzle body, said second air shim plate being positioned between said second end plate and said nozzle body.

10. The nozzle of claim 9, wherein said nozzle body includes a top surface positioned between said first and second surfaces, at least one air supply passage for directing pressurized process air from said top surface to said first surface, at least one process air supply passage for directing pressurized process air from said top surface to said second surface, and at least one liquid supply passage for directing pressurized liquid adhesive from said top surface to said first surface.

11. The nozzle of claim 10, wherein said first and second end plates define respective distribution channels for directing the pressurized process air from the associated first or second surface to said air slots in the associated first or second air shim plate.

12. The nozzle of claim 1, wherein said adhesive shim plate includes opposed ends and said liquid slots respectively angle outwardly in a progressive manner from a central portion of said adhesive shim plate toward said opposed ends.

13. The nozzle of claim 1, wherein each of said liquid slots is arranged generally between a pair of said air slots in said first air shim plate and a pair of said air slots in said second air shim plate thereby associating four of said air slots with each liquid slot.

14. The nozzle of claim 1, wherein each of said liquid slots is arranged generally between a pair of said air slots in said first air shim plate and one of said air slots in said second air shim plate thereby associating three of said air slots with each liquid slot.

15. The nozzle of claim 1, wherein each of said liquid slots is arranged generally between one of said air slots in said first air shim plate and one of said air slots in said second air shim plate thereby associating two of said air slots with each liquid slot.

16. The nozzle of claim 15, wherein said pluralities of air slots and said plurality of liquid slots are arranged in separate rows.

17. The nozzle of claim 15, wherein said pluralities of air slots and said plurality of liquid slots are arranged in a series.

18. A nozzle for dispensing a random pattern of liquid adhesive filaments, comprising:

first and second air shim plates, said first and second air shim plates having respective pairs of air slots, each of said air slots adapted to receive and direct pressurized process air; and an adhesive shim plate positioned between said first and second air shim plates, said adhesive shim plate having a plurality of liquid slots each arranged generally between a pair of said air slots in said first air shim plate and a pair of said air slots in said second air shim plate thereby associating four of said air slots with each liquid slot, said liquid slots adapted to receive pressurized liquid adhesive and discharge liquid adhesive filaments, the pressurized process air directed by each group of said four air slots moves said filaments of the pressurized liquid adhesive discharging from the associated liquid slot in a random pattern;

said air slots in said first air shim plate are configured to direct the pressurized process air along a first angle relative to said adhesive shim plate and said air slots in said second air shim plate are configured to direct the pressurized process air along a second angle relative to said adhesive shim plate, said first angle being different than said second angle so that said first and second air shim plates direct the pressurized process air asymmetrically toward the adhesive filaments.

19. The nozzle of claim 18, wherein the first angle is about 0° such that said first air shim plate is substantially parallel to said adhesive shim plate.

20. The nozzle of claim 19, further comprising:

a separating shim plate positioned between said first air shim plate and said adhesive shim plate.

21. The nozzle of claim 19, wherein the second angle is from about 40° to about 90°.

22. The nozzle of claim 18, wherein the second angle is about 70°.

23. The nozzle of claim 18, further comprising:

a nozzle body having first and second surfaces;

a first end plate secured to said first surface of said nozzle body, said first air shim plate and said adhesive shim plate being positioned between said first end plate and said nozzle body; and a second end plate secured to said second surface of said nozzle body, said second air shim plate being positioned between said second end plate and said nozzle body.

24. The nozzle of claim 23, wherein said first and second surfaces generally converge toward each other, said adhesive shim plate and said first air shim plate being coupled to said first surface so as to be arranged substantially parallel thereto, and said second air shim plate being coupled to said second surface so as to be arranged substantially parallel thereto.

25. The nozzle of claim 24, wherein said nozzle body includes a top surface positioned between said first and second surfaces, at least one air supply passage for directing pressurized process air from said top surface to said first surface, at least one process air supply passage for directing pressurized process air from said top surface to said second surface, and at least one liquid supply passage for directing pressurized liquid adhesive from said top surface to said first surface, said first and second end plates defining respective distribution channels for directing the pressurized process air from the associated first or second surface to said air slots in the associated first or second air shim plate.

26. The nozzle of claim 18, wherein said adhesive shim plate includes opposed ends and said liquid slots respectively angle outwardly in a progressive manner from a central portion of said adhesive shim plate toward said opposed ends.

27. The nozzle of claim 18, wherein said air slots each include an air inlet and an air outlet, said air slots of each pair converging toward one another such that said air inlets are farther apart than said air outlets in each pair.

28. The nozzle of claim 27, wherein said first and second air shim plates include respective tapered members defined between said air slots of each pair, said first and second air shim plates further including a bottom edge, said tapered members terminating above a plane including said bottom edge.

29. A nozzle for dispensing a plurality of liquid adhesive filaments in a random pattern, comprising:

a plurality of liquid outlets configured to respectively discharge the plurality of liquid adhesive filaments;

a first plurality of air passages, each air passage of said first plurality of air passages associated with one of said liquid outlets and configured to direct pressurized process air along a first angle relative to a plane including said associated liquid outlet; and a second plurality of air passages, each air passage of said second plurality of air passages associated with one of said liquid outlets and configured to direct pressurized process air along a second angle relative to the plane including said associated liquid outlet;

at least one of said first plurality of air passages and at least one of said second plurality of air passages being on opposite sides of one of said liquid outlets;

said first angle being different than said second angle so that the pressurized process air is asymmetrically directed from said first and second pluralities of air passages toward the respective liquid adhesive filaments to produce the random pattern.

30. The nozzle of claim 29, wherein said plurality of liquid outlets are arranged in a row and said first and second pluralities of air passages are located on opposite sides of a plane including said row.

31. The nozzle of claim 29, wherein said first and second pluralities of air passages and said plurality of liquid outlets are arranged in a series.

32. The nozzle of claim 29, wherein one of said first plurality of air passages is on a first side of said one liquid outlet and two of said second plurality of air passages are on a second, opposite side of said one liquid outlet thereby associating three air passages with each of said liquid outlets.

33. The nozzle of claim 29, wherein two of said first plurality of air passages are on a first side of said one liquid outlet and two of said second plurality of air passages are on a second, opposite side of said one liquid outlet thereby associating four air passages with each of said liquid outlets.

34. The nozzle of claim 29, further comprising:

a nozzle body having first and second surfaces;

a first end plate coupled to said nozzle body proximate said first surface, said first plurality of air passages defined between said nozzle body and said first end plate; and a second end plate coupled to said nozzle body proximate said second surface, said second plurality of air passages defined between said nozzle body and said second end plate.

35. The nozzle of claim 34, further comprising:

an adhesive shim plate coupled to said nozzle body, said adhesive shim plate having a plurality of liquid slots defining said plurality of liquid outlets.

* * * * *